US006503876B1

(12) United States Patent
Broeckx

(10) Patent No.: US 6,503,876 B1
(45) Date of Patent: Jan. 7, 2003

(54) STABLE NON-AQUEOUS LIQUID LAUNDRY DETERGENTS COMPRISING LOW DENSITY PARTICLES

(75) Inventor: Walter August Maria Broeckx, Zele (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/890,675

(22) PCT Filed: Feb. 9, 2000

(86) PCT No.: PCT/US00/03520

§ 371 (c)(1),
(2), (4) Date: Aug. 3, 2001

(87) PCT Pub. No.: WO00/47707

PCT Pub. Date: Aug. 17, 2000

Related U.S. Application Data

(60) Provisional application No. 60/119,555, filed on Feb. 10, 1999, and provisional application No. 60/131,523, filed on Apr. 29, 1999.

(51) Int. Cl.[7] ..... C11D 7/02; C11D 7/32; C11D 7/38; C11D 7/42

(52) U.S. Cl. ..... 510/349; 510/336; 510/337; 510/338; 510/438; 510/445; 510/449; 510/302; 510/303; 510/304; 510/320; 510/321

(58) Field of Search ..... 510/336, 337, 510/338, 349, 438, 445, 499, 302, 303, 304, 320, 321

(56) References Cited

U.S. PATENT DOCUMENTS

| | | | | |
|---|---|---|---|---|
| 3,615,972 A | * | 10/1971 | Morehouse, Jr. et al. | 156/79 |
| 3,864,181 A | * | 2/1975 | Wolinski et al. | 156/79 |
| 4,006,273 A | * | 2/1977 | Wolinski et al. | 427/278 |
| 4,615,820 A | | 10/1986 | Hepworth et al. | |
| 4,828,723 A | | 5/1989 | Cao et al. | |
| 5,176,713 A | | 1/1993 | Dixit et al. | |

FOREIGN PATENT DOCUMENTS

| | | | |
|---|---|---|---|
| EP | 0340989 | | 4/1989 |
| EP | 0578871 | A1 | 7/1992 |
| EP | 0839902 | | 10/1997 |
| GB | 2168377 | * | 6/1986 |
| GB | 2208233 | A | 7/1987 |
| GB | 2210383 | A | 6/1989 |

* cited by examiner

*Primary Examiner*—Gregory Delcotto
(74) *Attorney, Agent, or Firm*—Armina E. Matthews; Kim William Zerby; Steven W. Miller

(57) ABSTRACT

This invention relates to laundry detergent products, such as heavy duty aqueous and/or non-aqueous and/or gelled liquid laundry detergents and granular and/or powder laundry detergents, which include one or more low density particles and one or more particulate solids, such as enzymes, bleaching agents, builders, chelants, alkalinity sources, anti-redeposition agents, catalysts, surfactants, and other detergent ingredients, and optionally one or more conventional cleaning adjunct materials.

16 Claims, No Drawings

STABLE NON-AQUEOUS LIQUID LAUNDRY DETERGENTS COMPRISING LOW DENSITY PARTICLES

This application is a 371 of PCT/US00/03520 filed Feb. 9, 2000 and claims benefit of Prov. No. 60/119,555 filed Feb. 10, 1999 and claims benefit of No. 60/131,523 filed Apr. 29, 1999.

FIELD OF THE INVENTION

This invention relates to laundry detergent products, such as heavy duty aqueous and/or non-aqueous and/or gelled liquid laundry detergents and granular and/or powder laundry detergents, which include one or more low density particles and one or more particulate solids, such as enzymes, bleaching agents, builders, chelants, alkalinity sources (i.e., buffers), anti redeposition agents, catalysts, surfactants, and other detergent ingredients, and optionally one or more conventional cleaning adjunct materials.

BACKGROUND OF THE INVENTION

The incorporation of conventional detergent ingredients, such as bleaching agents, builders, chelants, alkalinity sources (i.e., buffers), anti redeposition agents, catalysts, surfactants, and other non-enzyme detergent ingredients into conventional liquid laundry detergents has been problematic due to the tendency of detergent ingredients, typically in the form of particulate solids, to sediment and/or settle out of liquid detergent products, especially during storage and/or transportation of the liquid detergent products. This problem is also present, although usually not to the same extent, in granular and/or powder laundry detergents wherein the solid particulates tend to sediment and/or settle out of the granular and/or powder detergent products during storage, transportation and/or any other activity that results in sifting of the products.

It is known that one of the major problems with built liquid laundry detergents is their physical stability. Non-aqueous built laundry liquid detergent compositions are often confronted with problems of phase separation, sedimentation and/or settling out of the suspended builder and other laundry additives. The considerations have an impact on, for example, product pourability, dispensability and/or stability.

Conventional non-aqueous heavy duty liquid detergents, which comprise a surfactant system in a non-aqueous organic solvent combined with particulate solids which have beneficial effects in the wash (e.g., bleaches and bleach activators), have a tendency to be quite unstable and thus, result in the sedimentation and/or settling out of the particulate solids as well as the formation of a clear liquid layer at the surface of the product.

This problem of unstability associated with non-aqueous heavy duty liquid detergents stems from the fact that the density of the solid suspended particles is higher than the density of the liquid matrix. Therefore, the solid particles tend to sediment according to Stoke's law.

U.S. Pat. No. 4,828,723 to Cao et al., U.S. Pat. No. 5,176,713 to Dixit et al., DE3824252 (GB 2208233) and DE 3833368 (GB2210383) all of which are owned by Colgate-Palmolive of New York, disclose stable non-aqueous heavy duty liquid laundry detergent compositions in the form of suspensions of builder salt in liquid nonionic surfactant wherein the compositions are stabilized against phase separation by the addition of small amounts of low density filler, such as hollow plastic or glass microspheres. All of the references teach that the ratio of the average particle size diameter of the low density filler particle to the average particle size diameter of the dispersed particles (i.e., builder salts) must be at least 6:1.

However, these references fail to teach laundry detergent compositions, particularly liquid laundry detergent compositions that comprise low density filler particles and solid particulates wherein the ratio of the average particle size diameter of the low density filler particle to the average particle size diameter of the dispersed solid particulates is about 1:1, or less than 2:1, or less than 3:1, or less than 4:1, or less than 5:1, or even less than 6:1.

Further, the low density filler materials used in these references tend to deposit on fabrics and on washing machine parts.

EP 839 902 (BASF) discloses a process for the production of micro-capsules containing a bleach aid for use in detergents. However, this reference fails to teach low density filler particles, especially non-detergent ingredient filled low density filler particles. Further, this reference fails to teach the use of water soluble and/or easily dispersible in water low density filler particles for improving the physical stability and the dissolution of laundry detergents, especially non-aqueous liquid laundry detergents.

Other unsuccessful prior art attempts at solving these problems associated with non-aqueous heavy duty liquid laundry detergents include forming a structuring network within the liquid laundry detergent such that the liquid laundry detergent acquires a high viscosity. High viscosity liquid laundry detergents can negatively impact the dissolution and the dispersion of the laundry detergent product in the wash, resulting in the deposition of imperfectly dissolved product on fabrics under stressed, low temperature/agitation conditions, or when the laundry detergent is used for pre-treating stains. Technologies used for this type of structuring network formation include polymers, clays and hydrophobic silica.

In light of the foregoing, it is evident that formulators of liquid laundry detergent comprising detergent ingredients in solid particulate form have encountered a challenge to stably suspend the detergent ingredients in the form of solid particulates in the liquid laundry detergents.

There is a need to formulate liquid laundry detergent compositions having stably suspended detergent ingredients in the form of solid particulates.

There is a need to formulate granular and/or powder laundry detergent compositions having stably suspended detergent ingredients in the form of solid particulates.

There is a need to provide methods for producing the laundry detergent compositions and/or products comprising detergent ingredient solid particulates wherein the solid particulates can be stably suspended in the laundry detergent compositions.

Accordingly, there is a need to identify materials and procedures which can be used to stably suspend and/or incorporate detergent ingredients in the form of solid particulates into liquid and/or granular and/or powder laundry detergent products.

SUMMARY OF THE INVENTION

The present invention fulfills the needs identified above by providing laundry detergent compositions and/or products comprising low density fillers and particulate solids wherein the laundry detergent compositions and/or products exhibit properties such that the tendency of the particulate solids to sediment and/or settle out of liquid laundry detergent products is reduced; methods of making such laundry detergent compositions and/or products.

Surprisingly it has been found that by incorporating low density fillers into laundry detergent compositions and/or products, especially non-aqueous liquid laundry detergents, that contain detergent ingredients in the form of particulate solids, the particulate solids can be stably suspended in liquid laundry detergent products.

By stably suspending the particulate solids in the liquid laundry detergent products, the particulate solids of the present invention have a reduced tendency to sediment and/or settle out of the laundry detergent products during storage and/or transportation.

As a result of the particulate solids having a reduced tendency to sediment and/or settle out of the laundry detergent products, consumers can have more consistent doses with respect to the level of actives, especially the particulate solids, per dose.

Further, as a result of the particulate solids having a reduced tendency to sediment and/or settle out of the laundry detergent products, the appearance of a clear top layer in the product is inhibited and/or resisted.

Still further, as a result of the particulate solids having a reduced tendency to sediment and/or settle out of the laundry detergent products, the dissollution of the product is not impaired as the low density fillers maintain a low product viscosity.

Still even further, as a result of the physical form and composition of the low density fillers, which are either water soluble or easily dispersible in water, the low density fillers do not result in unacceptable residues on fabric and on washing machine parts during use.

Accordingly, the present invention provides a way to suspend heavy solids in a laundry detergent, preferably a non-aqueous liquid laundry detergent without increasing the low shear viscosity of the detergent, thus avoiding any slow down of the rate of dissolution in the wash which may occur as a result of increasing the low shear viscosity of the detergent. In addition, by not increasing the low shear viscosity of the detergent, the mileage of the product is not reduced as a result of product hang-up in the bottle.

In one aspect of the present invention a laundry detergent composition and/or product comprising one or more low density filler particles and one or more detergent ingredients in the form of particulate solids is provided.

In another aspect of the present invention a liquid laundry detergent composition comprising one or more low density filler particles and one or more detergent ingredients in the form of particulate solids is provided.

In still another aspect of the present invention a granular and/or powder laundry detergent product comprising one or more low density filler particles and one or more detergent ingredients in the form of particulate solids is provided.

In yet another aspect of the present invention a method for producing the laundry detergent compositions and/or products of the present invention is provided.

In still yet another aspect of the present invention a method for laundering fabrics comprising contacting the fabrics with the laundry detergent compositions and/or products of the present invention, preferably the liquid laundry detergent composition and/or product of the present invention, is provided.

In even still another aspect of the present invention a method for stabilizing a liquid laundry detergent composition comprising particulate solids wherein the method comprises the step of adding low density filler particles to said composition is provided.

In still yet another aspect of the present invention a method for inhibiting the formation of a clear top layer in a liquid laundry detergent composition comprising particulate solids wherein the method comprises the step of adding low density filler particles to said composition is provided.

In even yet another aspect of the present invention a method for reducing and/or preventing the deposit of residues on a fabric in need of laundering during laundering of the fabric with a liquid laundry detergent composition comprising particulate solids wherein the method comprises the step of adding low density filler particles to said composition is provided.

It is an object of the present invention to formulate laundry detergent compositions and/or products that have properties such that the tendency of detergent ingredients in the form of particulate solids to sediment or settle out of the laundry detergent compositions and/or products is reduced as compared to laundry detergent compositions and/or products without such low density filler particles of the present invention.

These and other aspects, objects, features and advantages will be clear from the following detailed description, examples and appended claims.

All percentages, ratios and proportions herein are on a weight basis unless otherwise indicated. All documents cited herein are hereby incorporated by reference.

DETAILED DESCRIPTION OF THE INVENTION

The present invention relates to laundry detergent compositions and/or products that comprise one or more low density filler particles and one or more detergent ingredients in the form of particulate solids, wherein the laundry detergent compositions and/or products exhibit a reduced tendency of the particulate solids to sediment and/or settle out of the laundry detergent compositions and/or products.

"Low Density Filler Particles" herein is meant any component that when incorporated into a laundry detergent composition and/or product comprising particulate solids exhibits a reduced tendency for the particulate solids to sediment and/or settle out of the laundry detergent composition and/or product. Suitable examples of low density filler particles include, but are not limited to, water soluble or water insoluble organic or inorganic materials, microspheres (liquid hydrocarbon-containing and/or gas-containing depending upon temperature, and/or hollow) and other components that result in a reduction of the tendency of the particulate solids within a laundry detergent composition and/or product to sediment and/or settle out of the laundry detergent composition and/or product. Preferably the low density filler particles of the present invention are water soluble and/or easily dispersible in water.

"Particulate solids" herein is meant any detergent ingredient that is in the form of a solid (i.e., granules, powder, flakes, chips, particles, etc.). Preferably, the particulate solids have a particle size of from 1–2000 microns.

The laundry detergent compositions of the present invention, preferably the liquid laundry detergent compositions of the present invention, more preferably the non-aqueous liquid laundry detergent compositions of the present invention include the low density filler particles and particulate solids at levels such that the ratio of the average particle size diameter of the low density filler particles to the average particle size diameter of the dispersed particulate solids is preferably less than 6:1, more preferably less than 5:1, even more preferably less than 4:1, still even more preferably less than 3:1, yet even more preferably less than 2:1, most preferably about 1:1.

Low Density Filler Particles

Preferably, the low density filler particles are selected from the group consisting of: microspheres, cavity-forming components, pore-forming components and mixtures thereof. More preferably, the particulate solid density-reducing component is selected from the group consisting of microspheres, preferably liquid hydrocarbon-containing and/or gas-containing microspheres, more preferably liquid hydrocarbon-containing and/or gas-containing microspheres made of one or more materials selected from the group consisting of: plastics; proteins; silicaceous materials; ceramics and mixtures thereof.

Plastic microspheres of the present invention are preferably made of one or more plastics selected from the group consisting of: thermoplastics; acylonitrile; methacrylonitrile; polyacrylonitrile; polymethacrylonitrile and mixtures thereof.

Silicaceous microspheres of the present invention are preferably made of one or more silicaceous materials selected from the group consisting of glass.

It is desirable that the microspheres of the present invention are capable of expanding such that the microspheres' volume increases. It is even more desirable that the microspheres of the present invention are made of a material such that the density of the expanded microsphere is less than about 0.4 g/mL, more preferably less than about 0.2 g/mL, most preferably less than about 0.1 g/mL.

In order to aid in the expansion of the microspheres, it is desirable that the microspheres contain a suitable expanding agent. The expanding agent can be selected from the group consisting of liquid hydrocarbons, gases, and mixtures thereof. Suitable liquid hydrocarbons are liquid hydrocarbons that are vaporizable at a temperature lower than the softening point of the microsphere material. Examples include, but are not limited to, propane, propylene, butene, n-butane, isobutane, isopentane, neopentane, n-pentane, hexane, heptane, petroleum ether, halogenized methane, tetraalkylsilane and the like. In addition to the liquid hydrocarbons, which may be in gas form depending upon the temperature, the expanding agents may also be selected from the group consisting of nitrogen, carbon dioxide, oxygen, and mixtures thereof. Preferably, the expanding agent is isobutane.

Commercially available microspheres are available from Expancel of Sweden (an Akzo Nobel company) under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEX®.

Laundry Compositions

The laundry compositions of the present invention preferably also comprise, in addition to one or more low density filler particles of the present invention and one or more particulate solids of the present invention described hereinbefore, one or more cleaning adjunct materials, preferably compatible with the low density filler particles and the detergent ingredient particulate solid(s). The term "cleaning adjunct materials", as used herein, means any liquid, solid or gaseous material selected for the particular type of laundry composition desired and the form of the product (e.g., liquid; granule; powder; gel composition), which materials are also preferably compatible with the low density filler particles and the detergent ingredient particulate solids of the present invention.

The specific selection of cleaning adjunct materials are readily made by considering the surface, item or fabric to be cleaned, and the desired form of the composition for the laundry conditions during use (e.g., through the wash detergent use).

The term "compatible", as used herein, means the cleaning adjunct materials do not reduce the detersive activity of the non-enzyme detergent ingredients in the particulate solids to such an extent that the non-enzyme detergent ingredients are not effective as desired during normal use situations. Examples of suitable cleaning adjunct materials include, but are not limited to, surfactants, builders, bleaches, bleach activators, bleach catalysts, other enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, hydrolyzable surfactants, perservatives, antioxidants, anti-shrinkage agents, anti-wrinkle agents, germicides, fungicides, color speckles, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101. Specific cleaning adjunct materials are exemplified in detail hereinafter.

If the cleaning adjunct materials are not compatible with the low density filler particles and the detergent ingredient particulate solids within the laundry compositions, then suitable methods of keeping the cleaning adjunct materials separate from (not in contact with each other) the low density filler particles and the detergent ingredient particulate solids until combination of the cleaning adjunct materials and the low density filler particles and detergent ingredient particulate solids is appropriate can be used. Suitable methods can be any method known in the art, such as gelcaps, encapulation, tablets, physical separation, etc.

Preferably an effective amount of one or more particulate solids described above are included in compositions useful for laundering a variety of fabrics in need of cleaning.

As used herein, "effective amount of one or more particulate solids" refers to the quantity of particulate solids of the present invention described hereinbefore necessary to achieve the detersive activity necessary in the specific laundry composition. Such effective amounts are readily ascertained by one of ordinary skill in the art and is based on many factors, such as the particular enzyme used, the laundry application, the specific composition of the laundry composition, and whether a liquid or dry (e.g., granular, powder) composition is required, and the like.

The laundry detergent compositions of the present invention comprise:

(a) one or more low density filler particles of the present invention; and (b) one or more particulate solids of the present invention; and (c) optionally, one or more cleaning adjunct materials.

Preferably, a laundry detergent composition of the present invention comprises one or more low density filler particles of the present invention and one or more particulate solids of the present invention such that the density difference between the density of the laundry detergent composition and/or product and the density of the particulate solids is equivalent to the density difference seen in a laundry detergent composition and/or product wherein the density difference between the density of a laundry detergent composition and/or product and the density of a particulate solid is less than about 0.2 g/mL, more preferably less than about 0.1 g/mL, most preferably less than about 0.05 g/mL.

Preferably, the laundry detergent compositions and/or products of the present invention comprise from about 0.001%, preferably from about 0.1%, more preferably from about 0.25% by weight of the laundry compositions of one or more particulate solids of the present invention, to about 50%, preferably to about 25%, more preferably to about 10%.

Preferably, the laundry compositions comprise from about 0.1%, preferably from about 1%, more preferably from about 2%, by weight of the laundry compositions of one or more particulate solids of the present invention, to about 60%, preferably to about 40%, more preferably to about 25%.

Several examples of various laundry compositions wherein the particulate solids of the present invention may be employed are discussed in further detail below. Also, the laundry compositions may include from about 1% to about 99.9% by weight of the composition of the cleaning adjunct materials.

As used herein, "fabric laundry compositions" include hand and machine laundry detergent compositions including laundry additive compositions and compositions suitable for use in the soaking and/or pretreatment of stained fabrics.

When the laundry compositions of the present invention are formulated as compositions suitable for use in a laundry machine washing method, the compositions of the present invention preferably contain both a surfactant and a builder compound and additionally one or more cleaning adjunct materials preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional cleaning adjunct materials.

The compositions of the present invention can also be used as detergent additive products in solid or liquid form. Such additive products are intended to supplement or boost the performance of conventional detergent compositions and can be added at any stage of the laundry process.

If needed the density of the laundry detergent compositions herein ranges from 400 to 1200 g/liter, preferably 500 to 950 g/liter of composition measured at 20° C.

The "compact" form of the laundry compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition. In the compact compositions, the filler salt is present in amounts not exceeding 15% of the total composition, preferably not exceeding 10%, most preferably not exceeding 5% by weight of the composition. The inorganic filler salts, such as meant in the present compositions are selected from the alkali and alkaline-earth-metal salts of sulfates and chlorides. A preferred filler salt is sodium sulfate.

Liquid laundry compositions according to the present invention can also be in a "concentrated form", in such case, the liquid laundry compositions according the present invention will contain a lower amount of water, compared to conventional liquid detergents. Typically the water content of the concentrated liquid laundry composition is preferably less than 40%, more preferably less than 30%, most preferably less than 20% by weight of the laundry composition.

The laundry detergent compositions and/or products preferably incorporate low density filler particles of the present invention in an amount sufficient to suspend the particulate solids of the present invention such that the laundry detergent compositions and/or products of the present invention are similar in properties to laundry detergent compositions and/or products comprising particulate solids having a particle density of from about 0.8 to about 2.1 g/mL, more preferably from about 0.8 to about 1.5 g/mL, most preferably from about 0.9 to about 1.2 g/mL.

A. Liquid Laundry Detergent Compositions

Non-aqueous Based Heavy Duty Liquid Detergents

Surfactant-containing Liquid Phase

Non-aqueous, liquid, heavy-duty detergent compositions in accordance with the present invention are in the form of a stable suspension of solid, substantially insoluble particulate material dispersed throughout a structured, surfactant-containing liquid phase. Such detergent compositions comprise from about 49% to 99.95% by weight of the composition of a structured, surfactant-containing liquid phase formed by combining:

i) from about 1% to 80% by weight of said liquid phase of one or more nonaqueous organic diluents; and ii) from about 20% to 99% by weight of said liquid phase of a surfactant system comprising surfactants selected from the group consisting of anionic, nonionic, cationic surfactants and combinations thereof.

The surfactant-containing, non-aqueous liquid phase of the non-aqueous liquid laundry detergent compositions of the present invention will generally comprise from about 52% to about 98.9% by weight of the detergent compositions herein. More preferably, this liquid phase is surfactant-structured and will comprise from about 55% to 98% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc. The liquid phase of the detergent compositions herein is preferably formed from one or more non-aqueous organic diluents into which is mixed a surfactant structuring agent which is preferably a specific type of anionic surfactant-containing powder.

i. Non-aqueous Organic Diluents

The major component of the liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 100%, more preferably from about 50% to 80%, most preferably from about 55% to 75%, of a structured, surfactant-containing liquid phase. Preferably the liquid phase of the compositions herein, i.e., the non-aqueous liquid diluent component, will comprise both non-aqueous liquid surfactants and non-surfactant non-aqueous solvents.

ii. Non-aqueous Surfactant Liquids

Suitable types of non-aqueous surfactant liquids which can be used to form the liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If alcohol alkoxylate nonionic surfactant is utilized as part of the non-aqueous liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

Another type of non-aqueous surfactant liquid which may be utilized in this invention are the ethylene oxide (EO)—propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO—PO block polymer nonionics of this type are described in greater detail in Davidsohn and Milwidsky; *Synthetic Detergents, 7th Ed.*; Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. If present, the polyhydroxy fatty acid amide surfactants are preferably present in a concentration of from about 0.1 to about 8%. Materials of this type of nonionic surfactant are those which conform to the formula:

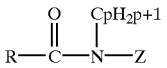

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The amount of total liquid surfactant in the preferred surfactant-structured, non-aqueous liquid phase herein will be determined by the type and amounts of other composition components and by the desired composition properties. Generally, the liquid surfactant can comprise from about 35% to 70% of the non-aqueous liquid phase of the compositions herein. More preferably, the liquid surfactant will comprise from about 50% to 65% of a non-aqueous structured liquid phase. This corresponds to a non-aqueous liquid surfactant concentration in the total composition of from about 15% to 70% by weight, more preferably from about 20% to 50% by weight, of the composition.

iii. Non-surfactant Non-aqueous Organic Solvents

The liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the trade names Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iv. Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the theological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

v. Surfactant Structurant

The non-aqueous liquid phase of the detergent compositions of this invention is prepared by combining with the non-aqueous organic liquid diluents hereinbefore described a surfactant which is generally, but not necessarily, selected to add structure to the non-aqueous liquid phase of the detergent compositions herein. Structuring surfactants can be of the anionic, nonionic, cationic, and/or amphoteric types.

Preferred structuring surfactants are the anionic surfactants such as the alkyl sulfates, the alkyl polyalkxylate sulfates and the linear alkyl benzene sulfonates. Another common type of anionic surfactant material which may be optionally added to the detergent compositions herein as structurant comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate. Yet another common type of anionic surfactant material which may be employed as a structurant comprises other sulfonated anionic surfactants such as the $C_8$–$C_{18}$ paraffin sulfonates and the $C_8$–$C_{20}$ olefin sulfonates. Structuring anionic surfactants will generally comprise from about 1% to 30% by weight of the compositions herein.

As indicated, one preferred type of structuring anionic surfactant comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10-14}$ alkyl, and M is alkali metal. Most preferably R is about $C_{12}$ and M is sodium.

Conventional secondary alkyl sulfates may also be utilized as a structuring anionic surfactant for the liquid phase of the compositions herein. Conventional secondary alkyl sulfate surfactants are those materials which have the sulfate moiety distributed randomly along the hydrocarbyl "backbone" of the molecule. Such materials may be depicted by the structure:

$$CH_3(CH_2)_n(CHOSO_3\text{-}M^+)(CH_2)_mCH_3$$

wherein m and n are integers of 2 or greater and the sum of m+n is typically about 9 to 15, and M is a water-solubilizing cation.

If utilized, alkyl sulfates will generally comprise from about 1% to 30% by weight of the composition, more preferably from about 5% to 25% by weight of the composition. Non-aqueous liquid detergent compositions containing alkyl sulfates, peroxygen bleaching agents, and bleach activators are described in greater detail in Kong-Chan et al.; WO 96/10073; Publiched Apr. 4, 1996, which application is incorporated herein by reference.

Another preferred type of anionic surfactant material which may be optionally added to the non-aqueous laundry compositions herein as a structurant comprises the alkyl polyalkoxylate sulfates. Alkyl polyalkoxylate sulfates are also known as alkoxylated alkyl sulfates or alkyl ether sulfates. Such materials are those which correspond to the formula $$R^2—O—(C_mH_{2m}O)_n—SO^3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium. Ammonium, alkylammonium and alkanolammonium counterions are preferably avoided when used in the compositions herein because of incompatibility with peroxygen bleaching agents.

If utilized, alkyl polyalkoxylate sulfates can also generally comprise from about 1% to 30% by weight of the composition, more preferably from about 5% to 25% by weight of the composition. Non-aqueous liquid detergent compositions containing alkyl polyalkoxylate sulfates, in combination with polyhydroxy fatty acid amides, are described in greater detail in Boutique et al; PCT Application No. PCT/US96/04223, which application is incorporated herein by reference.

The most preferred type of anionic surfactant for use as a structurant in the compositions herein comprises the linear alkyl benzene sulfonate (LAS) surfactants. In particular, such LAS surfactants can be formulated into a specific type of anionic surfactant-containing powder which is especially useful for incorporation into the non-aqueous liquid detergent compositions of the present invention. Such a powder comprises two distinct phases. One of these phases is insoluble in the non-aqueous organic liquid diluents used in the compositions herein; the other phase is soluble in the non-aqueous organic liquids. It is the insoluble phase of this preferred anionic surfactant-containing powder which can be dispersed in the non-aqueous liquid phase of the preferred compositions herein and which forms a network of aggregated small particles that allows the final product to stably suspend other solid particulate materials in the composition.

Such a preferred anionic surfactant-containing powder is formed by co-drying an aqueous slurry which essentially contains a) one of more alkali metal salts of $C_{10-16}$ linear alkyl benzene sulfonic acids; and b) one or more non-surfactant diluent salts. Such a slurry is dried to a solid material, generally in powder form, which comprises both the soluble and insoluble phases.

The linear alkyl benzene sulfonate (LAS) materials used to form the preferred anionic surfactant-containing powder are well known materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11-14}$, e.g., $C_{12}$, LAS is especially preferred. The alkyl benzene surfactant anionic surfactants are generally used in the powder-forming slurry in an amount from about 20 to 70% by weight of the slurry, more preferably from about 20% to 60% by weight of the slurry.

The powder-forming slurry also contains a non-surfactant, organic or inorganic salt component that is co-dried with the LAS to form the two-phase anionic surfactant-containing powder. Such salts can be any of the known sodium, potassium or magnesium halides, sulfates, citrates, carbonates, sulfates, borates, succinates, sulfo-succinates and the like. Sodium sulfate, which is generally a bi-product of LAS production, is the preferred non-surfactant diluent salt for use herein. Salts which function as hydrotropes such as sodium sulfo-succinate may also usefully be included. The non-surfactant salts are generally used in the aqueous slurry, along with the LAS, in amounts ranging from about 1 to 50% by weight of the slurry, more preferably from about 5% to 40% by weight of the slurry. Salts that act as hydrotropes can preferably comprise up to about 3% by weight of the slurry.

The aqueous slurry containing the LAS and diluent salt components hereinbefore described can be dried to form the anionic surfactant-containing powder preferably added to the non-aqueous diluents in order to prepare a structured liquid phase within the compositions herein. Any conventional drying technique, e.g., spray drying, drum drying, etc., or combination of drying techniques, may be employed. Drying should take place until the residual water content of the solid material which forms is within the range of from about 0.5% to 4% by weight, more preferably from about 1% to 3% by weight.

The anionic surfactant-containing powder produced by the drying operation constitutes two distinct phases, one of which is soluble in the inorganic liquid diluents used herein and one of which is insoluble in the diluents. The insoluble phase in the anionic surfactant-containing powder generally comprises from about 10% to 45% by weight of the powder, more preferably from about 15% to 35% by weight of a powder.

The anionic surfactant-containing powder that results after drying can comprise from about 45% to 94%, more preferably from about 60% to 94%, by weight of the powder of alkyl benzene sulfonic acid salts. Such concentrations are generally sufficient to provide from about 0.5% to 60%, more preferably from about 15% to 60%, by weight of the total detergent composition that is eventually prepared, of the alkyl benzene sulfonic acid salts. The anionic surfactant-containing powder itself can comprise from about 0.45% to 45% by weight of the total composition that is eventually prepared. After drying, the anionic surfactant-containing powder will also generally contain from about 2% to 50%, more preferably from about 2% to 25% by weight of the powder of the non-surfactant salts.

After it is dried to the requisite extent, the combined LAS/salt material can be converted to flakes or powder form by any known suitable milling or comminution process. Generally at the time such material is combined with the non-aqueous organic solvents to form the structured liquid phase of the compositions herein, the particle size of this powder will range from 0.1 to 2000 microns, more preferably from about 0.1 to 1000 microns.

A structured, surfactant-containing liquid phase of the preferred detergent compositions herein can be prepared by combining the non-aqueous organic diluents hereinbefore described with the anionic surfactant-containing powder as hereinbefore described. Such combination results in the formation of a structured surfactant-containing liquid phase. Conditions for making this combination of preferred structured liquid phase components are described more fully hereinafter in the "Composition Preparation and Use" section. As previously noted, the formation of a structured, surfactant-containing liquid phase permits the stable suspension of colored speckles and additional functional particulate solid materials within the preferred detergent compositions of this invention.

Additional suitable surfactants for use in the present invention included nonionic surfactants, specifically, polyhydroxy fatty acid amides of the formula:

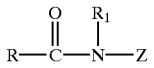

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Preferred surfactants for use in the detergent compositions described herein are amine based surfactants of the general formula:

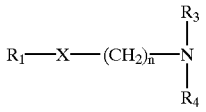

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$—$CH_2$—$O(R_5)$) wherein $R_5$ is H or methyl. Especially preferred amines based surfactants include the following:

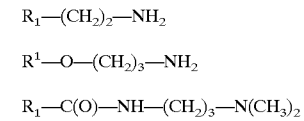

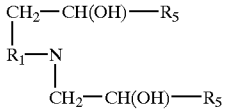

wherein $R^1$ is a $C_6$–$C_{12}$ alkyl group and $R_5$ is H or $CH_3$. Particularly preferred amines for use in the surfactants defined above include those selected from the group consisting of octyl amine, hexyl amine, decyl amine, dodecyl amine, $C_8$–$C_{12}$ bis(hydroxyethyl)amine, $C_8$–$C_{12}$ bis (hydroxyisopropyl)amine, $C_8$–$C_{12}$ amido-propyl dimethyl amine, or mixtures thereof.

In a highly preferred embodiment, the amine based surfactant is described by the formula:

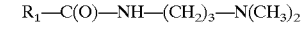

wherein $R_1$ is $C_8$–$C_{12}$ alkyl.

vi. Solid Particulate Materials

The non-aqueous detergent compositions herein preferably comprise from about 0.01% to 50% by weight, more preferably from about 0.2% to 30% by weight, of solid phase particulate material which is dispersed and suspended within the liquid phase. Generally such particulate material will range in size from about 0.1 to 1500 microns, more preferably from about 0.1 to 900 microns. Most preferably, such material will range in size from about 5 to 200 microns.

The particulate material utilized herein can comprise one or more types of detergent composition components which in particulate form are substantially insoluble in the non-aqueous liquid phase of the composition. The types of particulate materials which can be utilized are described in detail as follows:

Aqueous Based Heavy Duty Liquid Detergents Surfactants

The present invention also comprises aqueous based liquid detergent compositions. The aqueous liquid detergent compositions preferably comprise from about 10% to about 98%, preferably from about 30% to about 95%, by weight of an aqueous liquid carrier which is preferably water. Additionally, the aqueous liquid detergent compositions of the present invention comprise a surfactant system which preferably contains one or more detersive co-surfactants in addition to the branched surfactants disclosed above. The additional co-surfactants can be selected from nonionic detersive surfactant, anionic detersive surfactant, zwitterionic detersive surfactant, amine oxide detersive surfactant, and mixtures thereof. The surfactant system typically comprises from about 5% to about 70%, preferably from about 15% to about 30%, by weight of the detergent composition.

i. Anionic Surfactant

Anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

Generally speaking, anionic surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of a-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Particularly preferred anionic surfactants herein are the alkyl polyethoxylate sulfates of the formula:

$$RO(C_2H_4O)_xSO_3^-M^+$$

wherein R is an alkyl chain having from about 10 to about 22 carbon atoms, saturated or unsaturated, M is a cation which makes the compound water-soluble, especially an alkali metal, ammonium or substituted ammonium cation, and x averages from about 1 to about 15.

Preferred alkyl sulfate surfactants are the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates. Examples of fatty acids include capric, lauric, myristic, palmitic, stearic, arachidic, and behenic acid. Other fatty acids include palmitoleic, oleic, linoleic, linolenic, and ricinoleic acid.

ii. Nonionic Surfactant

Conventional nonionic and amphoteric surfactants include $C_{12}$–$C_{18}$ alkyl ethoxylates (AE) including the so-called narrow peaked alkyl ethoxylates and $C_6$–$C_{12}$ alkyl phenol alkoxylates (especially ethoxylates and mixed ethoxy/propoxy). The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Examples of nonionic surfactants are described in U.S. Pat. No. 4,285,841, Barrat et al, issued Aug. 25, 1981.

Preferred examples of these surfactants include ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Particularly preferred are ethoxylated alcohols having an average of from about 10 to abut 15 carbon atoms in the alcohol and an average degree of ethoxylation of from about 6 to about 12 moles of ethylene oxide per mole of alcohol. Mixtures of anionic and nonionic surfactants are especially useful.

Other conventional useful surfactants are listed in standard texts, including $C_{12}$–$C_{18}$ betaines and sulfobetaines (sultaines).

iii. Amine Oxide Surfactants

The compositions herein also contain amine oxide surfactants of the formula:

$$R_1(EO)_x(PO)_y(BO)_zN(O)(CH_2R')_{2-q}H_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R^1$=$C_8$–$C_{18}$, R' is H and q is 0–2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp.

Preferred embodiments include dodecyldimethylamine oxide dihydrate, hexadecyldimethylamine oxide dihydrate, octadecyldimethylamine oxide dihydrate, hexadecyltris (ethyleneoxy)dimethyl-amine oxide, tetradecyldimethylamine oxide dihydrate, and mixtures thereof.

Whereas in certain of the preferred embodiments R' is H, there is some latitude with respect to having R' slightly larger than H. Specifically, the invention further encompasses embodiments wherein R' is $CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide.

Heavy Duty Gel Laundry Detergent Compositions

The present invention encompasses a heavy duty gel laundry detergent compositions comprising, by weight of the composition:

a) from about 15% to about 40% of an anionic surfactant component which comprises, by weight of the composition:
   (i) from about 5% to about 25% of alkyl polyethoxylate sulfates wherein the alkyl group contains from about 10 to about 22 carbon atoms and the polyethoxylate chain contains from 0.5 to about 15, preferably from 0.5 to about 5, more preferably from 0.5 to about 4, ethylene oxide moieties; and
   (ii) from about 5% to about 20% of fatty acids; and
b) one or more of the following ingredients: detersive amine, modified polyamine, polyamide-polyamine, polyethoxylated-polyamine polymers, quaternary ammonium surfactants, suitable electrolyte or acid equivalents thereof, and mixtures thereof.

The compositions herein may further contain one or more additional detersive additives selected from the group consisting of non-citrate builders, optical brighteners, soil release polymers, dye transfer inhibitors, polymeric dispersing agents, enzymes, suds suppressers, dyes, perfumes, colorants, filler salts, hydrotropes, antiredeposition agents, antifading agent, dye fixative agents, prill/fuzzing reducing agents, and mixtures thereof.

The compositions herein have a viscosity at 20 $s^{-1}$ shear rate of from about 100 cp to about 4,000 cp, preferably from about 300 cp to about 3,000 cp, more preferably from about 500 cp to about 2,000 cp and are stable upon storage.

The compositions herein are structured and have a specific rheology. The rheology can be modeled by the following formula:

$$\eta=\eta_o+K\gamma^{(n-1)}$$

where $\eta$ is the viscosity of the liquid at a given shear rate, $\eta_o$ is the viscosity at infinite shear rate, $\gamma$ is the shear rate, n is the shear rate index, and K is the consistency index. As used herein, the term "structured" indicates a heavy duty liquid composition having a liquid crystalline lamellar phase and an infinite shear viscosity ($\eta o$) value between 0 and about 3,000 cp (centipoise), a shear index (n) value of less than about 0.6, a consistency index value, K, of above about 1,000, and a viscosity ($\eta$) measured at 20 $s^{-1}$ of less than about 10,000 cp, preferably less than about 5,000 cp. Under low stress levels, a "zero shear" viscosity is above about 100,000 cp wherein "zero shear" is meant a shear rate of 0.001 $s^{-1}$ or less. The yield value of the compositions herein, obtained by plotting viscosity versus stress, is larger than 0.2 Pa. These rheology parameters can be measured with any commercially available rheometer, such as the Carrimed CSL 100 model.

The compositions herein are clear or translucent, i.e. not opaque.

Electrolytes—Without being limited by theory, it is believed that the presence of electrolytes acts to control the viscosity of the gel compositions. Thus, the gel nature of the compositions herein are affected by the choice of surfactants and by the amount of electrolytes present. In preferred embodiments herein, the compositions will further comprise from 0% to about 10%, more preferably from about 1% to about 8%, even more preferably from about 2% to about 6%, of a suitable electrolyte or acid equivalent thereof. Sodium citrate is a highly preferred electrolyte for use herein.

The compositions herein may optionally contain from about 0% to about 10%, by weight, of solvents and hydrotropes. Without being limited by theory, it is believed that the presence of solvents and hydrotropes can affect the structured versus isotropic nature of the compositions; By "solvent" is meant the commonly used solvents in the detergent industry, including alkyl monoalcohol, di-, and tri-alcohols, ethylene glycol, propylene glycol, propanediol, ethanediol, glycerine, etc. By "hydrotrope" is meant the commonly used hydrotropes in the detergent industry, including short chain surfactants that help solubilize other surfactants. Other examples of hydrotropes include cumene, xylene, or toluene sulfonate, urea, $C_8$ or shorter chain alkyl carboxylates, and $C_8$ or shorter chain alkyl sulfate and ethoxylated sulfates.

Modified polyamine—The compositions herein may comprise at least about 0.05%, preferably from about 0.05% to about 3%, by weight, of a water-soluble or dispersible, modified polyamine agent, said agent comprising a polyamine backbone corresponding to the formula:

$$[(R^2)_2—N]_{\overline{w}}—[R^1—N]_{\overline{x}}—[R^1—N]_{\overline{y}}—[R^1—N]_z$$

B $R^2$ $(R^2)_2$ wherein each $R^1$ is independently $C_2$–$C_5$ alkylene, alkenylene or arylene; each $R^2$ is independently H, or a moiety of formula $OH[(CH_2)_xO]_n$, wherein x is from about 1 to about 8 and n is from about 10 to about 50; w is 0 or 1; x+y+z is from about 5 to about 30; and B represents a continuation of this structure by branching; and wherein said polyamine before alkylation has an average molecular weight of from about 300 to about 1,200.

In preferred embodiments, $R^1$ is $C_2$–$C_4$ alkylene, more preferably ethylene; $R^2$ is $OH[CH_2CH_2O]_n$, wherein n is from about 15 to about 30, more preferably n is about 20. The average Molecular Weight of the polyamine before alkylation is from about 300 to about 1200, more preferably from about 500 to about 900, still more preferably from about 600 to about 700, even more preferably from about 600 to about 650.

In another preferred embodiment, $R^1$ is $C_2$–$C_4$ alkylene, more preferably ethylene; $R^2$ is $OH[CH_2CH_2O]_n$, wherein n is from about 10 to about 20, more preferably n is about 15. The average Molecular Weight of the polyamine before alkylation is from about 100 to about 300, more preferably from about 150 to about 250, even more preferably from about 180 to about 200.

Polyamide-Polyamines—The polyamide-polyamines useful herein will generally comprise from about 0.1% to 8% by the weight of the composition. More preferably, such polyamide-polyamine materials will comprise from about 0.5% to 4% by weight of the compositions herein. Most preferably, these polyamide-polyamines will comprise from about 1% to 3% by weight of the composition.

The polyamide-polyamine materials used in this invention are those which have repeating, substituted amidoamine units which correspond to the general Structural Formula No. I as follows:

Structural Formula No. I

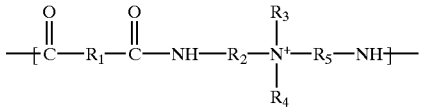

Structural Formula No. I, $R_1$, $R_2$ and $R_5$ are each independently $C_{1-4}$ alkylene, $C_{1-4}$ alkarylene or arylene. It is also possible to eliminate $R_1$ entirely so that the polyamide-polyamine is derived from oxalic acid.

Also in Structural Formula No. I, $R_3$ is H, epichlorohydrin, an azetidinium group, an epoxypropyl group or a dimethylaminohydroxypropyl group, and $R_4$ can be H, $C_{1-4}$ alkyl, $C_{1-4}$ alkaryl, or aryl. $R_4$ may also be any of the foregoing groups condensed with $C_{1-4}$ alkylene oxide.

$R_1$ is preferably butylene, and $R_2$ and $R_5$ are preferably ethylene. $R_3$ is preferably epichlorohydrin. $R_4$ is preferably H.

The polyamide-polyamine materials useful herein can be prepared by reacting polyamines such as diethylenetriamine, triethylenetetraamine, tetraethylenepentamine or dipropylenetriamine with $C_{2-12}$ dicarboxylic acids such as oxalic, succinic, glutaric, adipic and diglycolic acids. Such materials may then be further derivatized by reaction with, for example, epichlorohydrin. Preparation of such materials is described in greater detail in Keim, U.S. Pat. No. 2,296,116, Issued Feb. 23, 1960; Keim, U.S. Pat. No. 2,296,154, Issued Feb. 23, 1960 and Keim, U.S. Pat. No. 3,332,901, Issued Jul. 25, 1967.

The polyamide-polyamine agents preferred for use herein are commercially marketed by Hercules, Inc. under the tradename Kymene® Especially useful are Kymene 557H® and Kymene 557LX® which are epichlorohydrin adducts of polyamide-polyamines which are the reaction products of diethylenetriamine and adipic acid. Other suitable materials are those marketed by Hercules under the tradenames Reten® and Delsette®, and by Sandoz under the tradename Cartaretin®. These polyamide-polyamine materials are marketed in the form of aqueous suspensions of the polymeric material containing, for example, about 12.5% by weight of solids.

Detersive Amine—Suitable amine surfactants for use herein include detersive amines according to the formula:

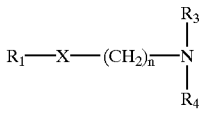

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$—$CH_2$—$O(R_5)$) wherein $R_5$ is H or methyl.

Preferred amines include the following:

$$R_1—(CH_2)_2—NH_2 \quad (1)$$

$$R_1—O—(CH_2)_3—NH_2 \quad (2)$$

$$R_1—C(O)—NH—(CH_2)_3—N(CH_3)_2 \quad (3)$$

$$CH_2—CH(OH)—R_5R_1—N \quad (4)$$

$$CH_2—CH(OH)—R_5$$

wherein $R_1$ is a $C_6$–$C_{12}$ alkyl group and $R_5$ is H or $CH_3$.

In a highly preferred embodiment, the amine is described by the formula:

$$R_1—C(O)—NH—(CH_2)_3—N(CH_3)_2$$

wherein $R_1$ is $C_8$–$C_{12}$ alkyl.

Particularly preferred amines include those selected from the group consisting of octyl amine, hexyl amine, decyl amine, dodecyl amine, $C_8$–$C_{12}$ bis(hydroxyethyl)amine, $C_8$–$C_{12}$ bis(hydroxyisopropyl)amine, and $C_8$–$C_{12}$ amidopropyl dimethyl amine, and mixtures.

If utilized the detersive amines comprise from about 0.1% to about 10%, preferably from about 0.5% to about 5%, by weight of the composition.

Quaternary Ammonium Surfactants—from about 1% to about 6% of a quaternary ammonium surfactant having the formula

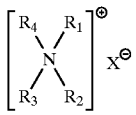

wherein $R_1$ and $R_2$ are individually selected from the group consisting of $C_1$–$C_4$ alky, $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6$–$C_{18}$ alkyl, and $R_4$ is selected from the group consisting of $C_1$–$C_{10}$ alkyl, $C_1$–$C_{10}$ hydroxy alkyl, benzyl, and —$(C_2H_4O)_xH$ where x has a value from 2 to 5.

Preferred quaternary ammonium surfactants are the chloride, bromide, and methylsulfate salts. Examples of preferred mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_8$–$C_{18}$ alkyl and $R_1$, $R_2$, and $R_4$ are selected from methyl and hydroxy-alkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethyl-monohydroxyethyl-ammonium chloride, coconut dimethyl-monohydroxyethylammonium methylsulfate, steryl dimethyl-monohydroxy-ethylammonium chloride, steryl dimethylmonohydroxy-ethylammonium methylsulfate, di-$C_{12}$–$C_{14}$ alkyl dimethyl ammonium chloride, and mixtures thereof are particularly preferred. ADOGEN 412™, a lauryl trimethyl ammonium chloride commercially available from Witco, is also preferred. Even more highly preferred are the lauryl trimethyl ammonium chloride and myristyl trimethyl ammonium chloride.

Alkoxylated quaternary ammonium (AQA) surfactants useful in the present invention are of the general formula:

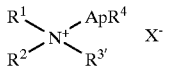

I

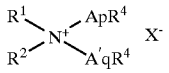

II wherein $R^1$ is an alkyl or alkenyl moiety containing from about 8 to about 18 carbon atoms, preferably 10 to about 16 carbon atoms, most preferably from about 10 to about 14 carbon atoms; $R^2$ and $R^{3'}$ are each independently alkyl groups containing from one to about three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, to provide electrical neutrality; A is selected from $C_1$–$C_4$ alkoxy, especially ethoxy (i.e., —$CH_2CH_2O$—), propoxy, butoxy and mixtures thereof;and for formula I, p is from 2 to about 30, preferably 2 to about 15, most preferably 2 to about 8; and for formula II, p is from 1 to about 30, preferably 1 to about 4 and q is from 1 to about 30, preferably 1 to about 4, and most preferably both p and q are 1.

Other quaternary surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl, ring structures formed by joining the two $R^4$ groups, —$CH_2CHOHCHOHCOR^6CHOH$—$CH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Polyethoxylated-Polyamine Polymers—Another polymer dispersant form use herein includes polyethoxyated-polyamine polymers (PPP). The preferred polyethoxylated-polyamines useful herein are generally polyalkyleneamines (PAA's), polyalkyleneimines (PAI's), preferably polyethyleneamine (PEA's), polyethyleneimines (PEI's). A common polyalkyleneamine (PAA) is tetrabutylenepentamine. PEA's are obtained by reactions involying ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Polyethoxylated polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

Optionally, but preferred polyethoxyated-polyamine polymers useful for this invention are alkoxylated quaternary diamines of the general formula:

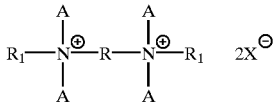

where R is selected from linear or branched $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $[(CH_2CH_2O)_qCH_2CH_2]$— and —$CH_2CH(OH)CH_2O$—$(CH_2CH_2O)_qCH_2CH(OH)CH_2]$— where q is from about 1 to about 100. Each $R_1$ is independently selected from $C_1$–$C_4$ alkyl, $C_7$–$C_{12}$ alkylaryl, or A. A is of the formula:

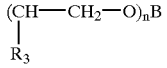

where $R_3$ is selected from H or $C_1$–$C_3$ alkyl, n is from about 5 to about 100, and B is selected from H, $C_1$–$C_4$ alkyl, acetyl, or benzoyl; X is a water soluble anion.

In preferred embodiments, R is selected from $C_4$ to $C_8$ alkylene, $R_1$ is selected from $C_1$–$C_2$ alkyl or $C_2$–$C_3$ hydroxyalkyl, and A is:

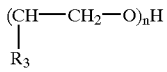

where $R_3$ is selected from H or methyl, and n is from about 10 to about 50.

In another preferred embodiment R is linear or branched $C_6$, $R_1$ is methyl, $R_3$ is H, and n is from about 20 to about 50.

Additional alkoxylated quaternary polyamine dispersants which can be used in the present invention are of the general formula:

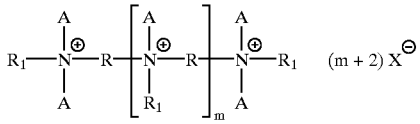

where R is selected from linear or branched $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $[(CH_2CH_2O)_qCH_2CH_2]$— and —$CH_2CH(OH)CH_2O$—$(CH_2CH_2O)_qCH_2CH(OH)CH_2]$— where q is from about 1 to about 100. If present, Each $R_1$ is independently selected from $C_1$–$C_4$ alkyl, $C_7$–$C_{12}$ alkylaryl, or A. $R_1$ may be absent on some nitrogens; however, at least three nitrogens must be quaternized.

A is of the formula:

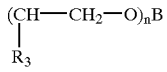

where $R_3$ is selected from H or $C_1$–$C_3$ alkyl, n is from about 5 to about 100 and B is selected from H, $C_1$–$C_4$ alkyl, acetyl, or benzoyl; m is from about 0 to about 4, and X is a water soluble anion.

In preferred embodiments, R is selected from $C_4$ to $C_8$ alkylene, $R_1$ is selected from $C_1$–$C_2$ alkyl or $C_2$–$C_3$ hydroxyalkyl, and A is:

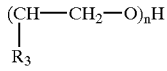

where $R_3$ is selected from H or methyl, and n is from about 10 to about 50; and m is 1.

In another preferred embodiment R is linear or branched $C_6$, $R_1$ is methyl, $R_3$ is H, and n is from about 20 to about 50, and m is 1.

The levels of these polyethoxyated-polyamine polymers used can range from about 0.1% to about 10%, typically from about 0.4% to about 5%, by weight. These polyethoxyated-polyamine polymers can be synthesized following the methods outline in U.S. Pat. No. 4,664,848, or other ways known to those skilled in the art.

Anionic Surfactant—The anionic surfactant component contains alkyl polyethoxylate sulfates and may contain other non-soap anionic surfactants or mixtures thereof.

Generally speaking, anionic surfactants useful herein are disclosed in U.S. Pat. No. No. 4,285,841, Barrat et al, issued Aug. 25, 1981, and in U.S. Pat. No. 3,919,678, Laughlin et al, issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil. Especially valuable are linear straight chain alkylbenzene sulfonates in which the average number of carbon atoms in the alkyl group is from about 11 to 13, abbreviated as $C_1$–$C_{13}$LAS.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

The alkyl polyethoxylate sulfates useful herein are of the formula $$RO(C_2H_4O)_xSO_3^-M^+$$

wherein R is an alkyl chain having from about 10 to about 22 carbon atoms, saturated or unsaturated, M is a cation which makes the compound water-soluble, especially an alkali metal, ammonium or substituted ammonium cation, and x averages from about 0.5 to about 15.

Preferred alkyl sulfate surfactants are the non-ethoxylated $C_2$–$C_{15}$ primary and secondary alkyl sulfates. Under cold water washing conditions, i.e., less than abut 65° F. (18.3° C.), it is preferred that there be a mixture of such ethoxylated and non-ethoxylated alkyl sulfates.

Fatty Acids—Moreover, the anionic surfactant component herein comprises fatty acids. These include saturated and/or unsaturated fatty acids obtained from natural sources or synthetically prepared. Examples of fatty acids include capric, lauric, myristic, palmitic, stearic, arachidic, and behenic acid. Other fatty acids include palmitoleic, oleic, linoleic, linolenic, and ricinoleic acid.

Nonionic Detergent Surfactants—Suitable nonionic detergent surfactants are generally disclosed in U.S. Pat. No. 3,929,678, Laughlin et al., issued Dec. 30, 1975, and U.S. Pat. No. 4,285,841, Barrat et al, issued Aug. 25, 1981. Exemplary, non-limiting classes of useful nonionic surfactants include: $C_8$–$C_{18}$ alkyl ethoxylates ("AE"), with EO about 1–22, including the so-called narrow peaked alkyl ethoxylates and $C_6$–$C_{12}$ alkyl phenol alkoxylates (especially ethoxylates and mixed ethoxy/propoxy), alkyl dialkyl amine oxide, alkanoyl glucose amide, and mixtures thereof.

If nonionic surfactants are used, the compositions of the present invention will preferably contain up to about 10%, preferably from 0% to about 5%, more preferably from 0% to about 3%, by weight of an nonionic surfactant. Preferred are the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Particularly preferred are ethoxylated alcohols having an average of from about 10 to abut 15 carbon atoms in the alcohol and an average degree of ethoxylation of from about 6 to about 12 moles of ethylene oxide per mole of alcohol.

Other nonionic surfactants for use herein include:

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23–6.5 (the condensation product of $C_{12}$–$C_{13}$ linear alcohol with 6.5 moles of ethylene oxide), Neodol®& 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol LID-080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic® compounds, marketed by BASF.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C^2H_4O)_xH$ where x varies from about 1 to about 3.

Preferred amides are $C_8$–$C_{20}$ ammonia amides, monoethanolamides, diethanolamides, and isopropanolamides.

Cationic/amphoteric—Non-quaternary, cationic detersive surfactants can also be included in detergent compositions of the present invention. Cationic surfactants useful herein are described in U.S. Pat. No. 4,228,044, Cambre, issued Oct. 14, 1980.

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and mixtures thereof.

Polyhydroxy Fatty Acid Amide Surfactant—The detergent compositions hereof may also contain polyhydroxy fatty acid amide surfactant. The polyhydroxy fatty acid amide surfactant component comprises compounds of the structural formula:

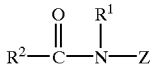

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

B. Granular and/or Powder Laundry Detergent Compositions

Granular and/or powder laundry detergent compositions preferably comprise, in addition to the particulate solids of the present invention, one or more cleaning adjunct materials as described herein.

Cleaning Adjunct Materials

The laundry detergent compositions of the present invention as described hereinbefore may optionally include, in addition to the particulate solids of the present invention, cleaning adjunct materials described below.

Biodegradably Branched Surfactants

The present invention includes important embodiments comprising at least one biodegradably branched and/or crystallinity disrupted and/or mid-chain branched surfactant or surfactant mixture. The terms "biodegradably branched" and/or "crystallinity disrupted" and/or "mid-chain branched" (acronym "MCB" used hereinafter) indicate that such surfactants or surfactant mixtures are characterized by the presence of surfactant molecules having a moderately non-linear hydrophobe; more particularly, wherein the surfactant hydrophobe is not completely linear, on one hand, nor is it branched to an extent that would result in unacceptable biodegradation. The preferred biodegradably branched surfactants are distinct from the known commercial LAS, ABS, Exxal, Lial, etc. types, whether branched or unbranched. The biodegradably branched materials comprise particularly positioned light branching, for example from about one to about three methyl, and/or ethyl, and/or propyl or and/or butyl branches in the hydrophobe, wherein the branching is located remotely from the surfactant headgroup, preferably toward the middle of the hydrophobe. Typically from one to three such branches can be present on a single hydrophobe, preferably only one. Such biodegradably branched surfactants can have exclusively linear aliphatic hydrophobes, or the hydrophobes can include cycloaliphatic or aromatic substitution. Highly preferred are MCB analogs of common linear alkyl sulfate, linear alkyl poly(alkoxylate) and linear alkylbenzenesulfonate surfactants. said surfactant suitably being selected from mid-chain-$C_1$–$C_4$-branched $C_8$–$C_{18}$-alkyl sulfates, mid-chain-$C_1$–$C_4$-branched $C_8$–$C_{18}$-alkyl ethoxylated, propoxylated or butoxylated alcohols, mid-chain-$C_1$–$C_4$-branched $C_8$–$C_{18}$-alkyl ethoxysulfates, mid-chain-$C_1$–$C_4$-branched $C_8$–$C_{16}$-alkyl benzenesulfonates and mixtures thereof. When anionic, the surfactants can in general be in acid or salt, for example sodium, potassium, ammonium or substituted ammonium, form. The biodegradably branched surfactants offer substantial improvements in cleaning performance and/or usefulness in cold water and/or resistance to water hardness and/or economy of utilization. Such surfactants can, in general, belong to any known class of surfactants, e.g., anionic, nonionic, cationic, or zwitterionic. The biodegradably branched surfactants are synthesized through processes of Procter & Gamble, Shell, and Sasol. These surfactants are more fully disclosed in WO98/23712 A published Jun. 4, 1998; WO97/38957 A published Oct. 23, 1997; WO97/38956 A published Oct. 23, 1997; WO97/39091 A published Oct. 23, 1997; WO97/39089 A published Oct. 23, 1997; WO97/39088 A published Oct. 23, 1997; WO97/39087 A1 published Oct. 23, 1997; WO97/38972 A published Oct. 23, 1997; WO 98/23566 A Shell, published Jun. 4, 1998; technical bulletins of Sasol; and the following pending patent applications assigned to Procter & Gamble:

Preferred biodegradably branched surfactants herein in more detail include MCB surfactants as disclosed in the following references:

WO98/23712 A published Jun. 4, 1998 includes disclosure of MCB nonionic surfactants including MCB primary alkyl polyoxyalkylenes of formula (1):

$$CH_3CH_2CH_2)_wC(R)H(CH_2)_xC(R^1)H(CH_2)_yC(R^2)H(CH_2)_z(EO/PO)_mOH \quad (1),$$

where the total number of carbon atoms in the branched primary alkyl moiety of this formula, including the R, $R^1$ and $R^2$ branching, but not including the carbon atoms in the EO/PO alkoxy moiety, is preferably 14–20, and wherein further for this surfactant mixture, the average total number of carbon atoms in the MCB primary alkyl hydrophobe moiety is preferably 14.5–17.5, more preferably 15–17; R, $R^1$ and $R^2$ are each independently selected from hydrogen and 1–3C alkyl, preferably methyl, provided R, $R^1$ and $R^2$ are not all hydrogen and, when z is 1, at least R or $R^1$ is not hydrogen; w is an integer of 0–13; x is an integer of 0–13; y is an integer of 0–13; z is an integer of at least 1; w+x+y+z is 8–14; an EO/PO are alkoxy moieties preferably selected from ethoxy, propoxy and mixed ethoxy/propoxy groups, where m is at least 1, preferably 3–30, more preferably 5–20, most preferably 5–15. Such MCB nonionics can alternately include butylene oxide derived moieties, and the —OH moiety can be replaced by any of the well-known end-capping moieties used for conventional nonionic surfactants.

WO97/38957 A published Oct. 23, 1997 includes disclosure of mid- to near-mid-chain branched alcohols of formulae $R—CH_2CH_2CH(Me)CH—R^1—CH_2OH$ (I) and $HOCH_2—R—CH_2—CH_2—CH(Me)—R'$ (II) comprising: (A) dimerising alpha-olefins of formula $RCH{=}CH_2$ and $R^1CH{=}CH_2$ to form olefins of formula $R(CH_2)_2—C(R^1){=}CH_2$ and $R^1(CH_2)_2—C(R){=}CH_2$; (B) (i) isomerising the olefins and then reacting them with carbon monoxide/hydrogen under Oxo conditions or (ii) directly reacting the olefins from step (A) with $CO/H_2$ under Oxo conditions. In the above formulae, R, $R^1$=3–7C linear alkyl. WO97/38957 A also discloses (i) production of MCB alkyl sulphate surfactants by sulphating (I) or (II); (ii) preparation of MCB alkylethoxy sulphates which comprises ethoxylating and then sulphating (I) or (II); (iii) preparation of MCB alkyl carboxylate surfactants which comprises oxidising (I) or (II) or their aldehyde intermediates and (iv) preparation of MCB acyl taurate, MCB acyl isethionate, MCB acyl sarcosinate or MCB acyl N-methylglucamide surfactants using the branched alkyl carboxylates as feedstock.

WO97/38956 A published Oct. 23, 1997 discloses the preparation of mid- to near mid-chain branched alpha olefins which is effected by: (a) preparing a mixture of carbon monoxide and hydrogen; (b) reacting this mixture in the presence of a catalyst under Fischer-Tropsch conditions to prepare a hydrocarbon mixture comprising the described olefins; and (c) separating the olefins from the hydrocarbon mixture. WO97/38956 A further discloses the preparation of mid- to near mid-chain branched alcohols by reacting the olefins described with $CO/H_2$ under Oxo conditions. These alcohols can be used to prepare (1) MCB sulphate surfactants by sulphating the alcohols; (2) MCB alkyl ethoxy sulphates by ethoxylating, then sulphating, the alcohols; or (3) branched alkyl carboxylate surfactants by oxidising the alcohols or their aldehyde intermediates. The branched carboxylates formed can be used as a feedstock to prepare branched acyl taurate, acyl isethionate, acyl sarcosinate or acyl N-methylglucamide surfactants, etc.

WO97/39091 A published Oct. 23, 1997 includes disclosure of a detergent surfactant composition comprising at least 0.5 (especially 5, more especially 10, most especially 20) wt % of longer alkyl chain, MCB surfactant of formula (I). A-X-B (I) wherein A is a 9–22 (especially 12–18) C MCB alkyl hydrophobe having: (i) a longest linear C chain attached to the X-B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from C 1 which is attached to the $CH_2B$ moiety, to the omega-2 carbon (the terminal C minus 2C); and (iv) the surfactant composition has an average total number of C atoms in the A-X moiety of 14.5–17.5 (especially 15–17); and B is a hydrophilic (surfactant head-group) moiety preferably selected from sulfates, sulfonates, polyoxyalkylene (especially polyoxyethylene or polyoxypropylene), alkoxylated sulphates, polyhydroxy moieties, phosphate esters, glycerol sulphonates, polygluconates, polyphosphate esters, phosphonates, sulphosuccinates, sulphosuccinates, polyalkoxylated carboxylates, glucamides, taurinates, sarcosinates, glycinates, isethionates, mono-/di-alkanol-amides, monoalkanolamide sulphates, diglycol-amide and their sulphates, glyceryl esters and their sulphates, glycerol ethers and their sulphates, polyglycerol ether and their sulphates, sorbitan esters, polyalkoxylated sorbitan esters, ammonio-alkanesulphonates, amidopropyl betaines, alkylated quat., alkylated/poly-hydroxyalkylated (oxypropyl) quat., imidazolines, 2-yl succinates, sulphonated alkyl esters and sulphonated fatty acids; and X— is $—CH_2—$ or —C(O)—. WO97/39091 A also discloses a laundry detergent or other cleaning composition comprising: (a) 0.001–99% of detergent surfactant (I); and (b) 1–99.999% of adjunct ingredients.

WO97/39089 A published Oct. 23, 1997 includes disclosure of liquid cleaning compositions comprising: (a) as part of surfactant system 0.1–50 (especially 1–40) wt % of a mid-chain branched surfactant of formula (I); (b) as the other part of the surfactant system 0.1–50 wt % of co-surfactant(s); (c) 1–99.7 wt % of a solvent; and (d) 0.1–75 wt % of adjunct ingredients. Formula (I) is $A-CH_2-B$ wherein A=9–22 (especially 12–18) C MCB alkyl hydrophobe having: (i) a longest linear C chain attached to the X-B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from Carbon No. 1 which is attached to the $CH_2B$ moiety, to the omega-2 carbon (the terminal C minus 2C); and (iv) the surfactant composition has an average total number of C atoms in the A-X moiety of 14.5–17.5 (especially 15–17); and B is a hydrophilic moiety selected from sulphates, polyoxyalkylene (especially polyoxyethylene and polyoxypropylene) and alkoxylated sulphates.

WO97/39088 A published Oct. 23, 1997 includes disclosure of a surfactant composition comprising 0.001–100% of MCB primary alkyl alkoxylated sulphate(s) of formula (I):

$$CH_3CH_2(CH)_wCHR(CH_2)_xCHR^1(CH_2)_yCHR^2(CH_2)_zOSO_3M \quad (I)$$

wherein the total number of C atoms in compound (I) including R, $R^1$ and $R^2$, is preferably 14–20 and the total number of C atoms in the branched alkyl moieties preferably averages 14.5–17.5 (especially 15–17); R, $R^1$ and $R^2$ are selected from H and 1–3C alkyl (especially Me) provided R, $R^1$ and $R^2$ are not all H; when z=1 at least R or $R^1$ is not H; M are cations especially selected from Na, K, Ca, Mg, quaternary alkyl ammonium of formula $N^+R^3R^4R^5R^6$ (II); M is especially Na and/or K; $R^3$, $R^4$, $R^5$, $R^6$ are selected from H, 1–22C alkylene, 4–22C branched alkylene, 1–6C alkanol, 1–22C alkenylene, and/or 4–22C branched alkenylene; w, x, y=0–13; z is at least 1; w+x+y+z=8–14. WO97/39088 A also discloses (1) a surfactant composition comprising a mixture of branched primary alkyl sulphates of formula (I) as above. M is a water-soluble cation; When $R^2$ is 1–3C alkyl, the ratio of surfactants having z=1 to surfactants having z=2 or greater is preferably at least 1:1 (most especially 1:100); (2) a detergent composition comprising: (a) 0.001–99% of MCB primary alkyl alkoxylated sulphate of formula (III) and/or (IV).

$$CH_3(CH_2)_aCH(CH_3)(CH_2)_bCH_2OSO_3M \quad (III)$$

$$CH_3(CH_2)_dCH(CH_3)(CH_2)_eCH(CH_3)CH_2OSO_3M \quad (IV)$$

wherein a, b, d, and e are integers, preferably a+b=10–16, d+e=8–14 and when a+b=10, a=2–9 and b=1–8; when a+b=11, a=2–10 and b=1–9; when a+b=12, a=2–11 and b=1–10; when a+b=13, a=2–12 and b=1–11; when a+b=14, a=2–13 and b=1–12; when a+B=15, a=2–14 and b=1–13; when a+b=16, a=2–14 and b=1–14; when d+e=8, d=2–7 and e=1–6, when d+e=9, d=2–8 and e=1–7; when d+e=10, d=2–9 and e=1–8; when d+3=11, d=2–10 and e=1–9; when d+e=12, d=2–11 and e=1–10; when d+e=13, d=2–12 and e=1–11; when d+e=14, d=2–13 and e=1–12; and (b) 1–99.99 wt % of detergent adjuncts; (3) a mid-chain branched primary alkyl sulphate surfactant of formula(V):

$$CH_3CH_2(CH_2)_xCHR^1(CH_2)_yCHR^2(CH_2)_zOSO_3M \quad (V)$$

wherein x, y=0–12; z is at least x+y+z=11–14; $R^1$ and $R^2$ are not both H; when one of $R^1$ or $R^2$ is H, and the other is Me, x+y+z is not 12 or 13; and when $R^1$ is H and $R^2$ is Me, x+y is not 11 when z=3 and x+y is not 9 when z=5; (4) Alkyl sulphates of formula (III) in which a and b are integers and a=b=12 or 13, a=2–11, b=1–10 and M is Na, K, and optionally substituted ammonium; (5) alkyl sulphates of formula (IV) in which d and e are integers and d=e is 10 or 11 and when d=e is 10, d=2–9 and e=1–8; when d=e=11, d=2–10 and e=1–9 and m is Na, K, optionally substituted ammonium (especially Na); (6) methyl branched primary alkyl sulphates selected from 3-, 4-, 5-, 6-, 7-, 8-, 9-, 10-, 11-, 12- or 13-methyl pentadecanol sulphate; 3-, 4-, 5-, 6-, 7-, 8-, 9-, 10-, 11-, 12-, 13-, or 14-methyl hexadecanol sulphate; 2,3-, 2,4-, 2,5-, 2,6-, 2,7-, 2,8-, 2,9-, 2,10-, 2,11-, 2,12methyl tetradecanol sulphate; 2,3-, 2,4-, 2,5-, 2,6-, 2,7-, 2,8-, 2,9-, 2,10-, 2,11-, 2,12-, or 2,13-methyl pentadecanol sulphate and/or mixtures of these compounds.

WO97/39087 A published Oct. 23, 1997 includes disclosure of a surfactant composition comprising 0.001–100% of mid-chain branched primary alkyl alkoxylated sulphate(s) of formula (I) wherein that total number of C atoms in compound (I) including R, $R^1$ and $R^3$, but not including C atoms of EO/PO alkoxy moieties is 14–20 and the total number of C atoms in branched alkyl moieties averages 14.5–17.5 (especially 15–17); R, $R^1$ and $R^2$=H or 1–3C alkyl (especially Me) and R, $R^1$ and $R^2$ are not all H; when z=1 at least R or $R^1$ is not H; M=cations especially selected from Na, K, Ca, Mg, quaternary alkyl amines of formula (II) (M is especially Na and/or K) $R^3$, $R^4$, $R^5$, $R^6$=H, 1–22C alkylene, 4–22C branched alkylene, 1–6C alkanol, 1–22C alkenylene, and/or 4–22C branched alkenylene; w, x, y=0–13; z is at least 1; w+x+y+z=8–14; EO/PO are alkoxy moieties, especially ethoxy and/or propoxy; m is at least 0.01, especially 0.1–30, more especially 0.5–10, most especially 1–5. Also disclosed are: (1) a surfactant composition comprising a mixture of branched primary alkyl alkoxylated sulphates of formula (I) When $R^2$=1–3C alkyl, the ratio of surfactants having z=2 or greater to surfactant having z=1 is at least 1:1, especially 1.5:1, more especially 3:1, most especially 4:1; (2) a detergent composition comprising: (a) 0.001–99% of mid-chain branched primary alkyl alkoxylated sulphate of formula (III) and/or (IV) M is as above; a, b, d, and e are integers, a+b=10–16, d+e=8–14 and when a+b=10, a=2–9 and b=1–8; when a+b=11, a=2–10 and b=1–9; when a+b=12, a=2–11 and b=1–10; when a+b=13, a=2–12 and b=1–11; when a+b=14, a=2–13 and b=1–12; when a+b=15, a=2–14 and b=1–13; when a+b=16, a=2–14 and b=1–14; when d+e=8, d=2–7 and e=1–6; when d+e=9, d=2–8 and e=1–7; when d+e=10, d=2–9 and e=1–8; when d+e=11, d=2–10 and e=1–9; when d+e=12, d=2–11 and e=1–10; when d+e=13,d=2–12 and e=1–11; when d+e=14, d=2–13 and e=1–12; and (b) 1–99.99 wt % of detergent adjuncts; (3) a MCB primary alkyl alkoxylated sulphate surfactant of formula(V) R1, R2, M, EO/PO, m as above; x,y=0–12; z is at least 2; x+y+z=11–14; (4) a mid-chain branched alkyl alkoxylated sulphate of formula (III) in which: a=2–11; b=1–10; a+b=12 or 13; M, EO/PO and m are as above; (5) a mid-chain branched alkyl alkoxylated sulphate compound of formula (IV) in which: d+e=10 or 11; when d+e=10, d=2–9 and e=1–8 and when d+e=11, d=2 and e=1–9; M is as above (especially Na); EO/PO and m are as above; and (6) methyl branched primary alkyl ethoxylated sulphates selected from 3-, 4- ,5-, 6-, 7-, 8-, 9-, 10-, 1-, 12- or 13-methyl pentadecanol ethoxylated sulphate; 3-, 4-, 5-, 6-, 7-, 8-, 9-, 10-, 11-, 12-, 13-, or 14-methyl hexadecanol ethoxylated sulphate; 2,3-, 2,4-, 2,5-, 2,6-, 2,7-, 2,8-, 2,9-, 2,10-, 2,11-, 2,12-methyl tetradecanol ethoxylated sulphate; 2,3-, 2,4-, 2,5-, 2,6-, 2,7-, 2,8-, 2,9-, 2,10-, 2,11-, 2,12-, or 2,13-methyl pentadecanol ethoxylated sulphate and/or mixtures of these compounds. The compounds are ethoxylated with average degree of ethoxylation of 0.1–10.

WO97/38972 A published Oct. 23, 1997 includes disclosure of a method for manufacturing longer chain alkyl sulphate surfactant mixture compositions comprising (a) sulphating with $SO_3$, preferably in a falling film reactor, a long chain aliphatic alcohol mixture having an average carbon chain length of at least 14.5–17.5, the alcohol mixture comprising at least 10%, preferably at least 25%, more preferably at least 50% still more preferably at least 75%, most preferably at least 95% of a MCB aliphatic alcohol having formula (I); where: R,$R^1$,$R^2$=H or 1–3C alkyl, preferably methyl, provided R, $R^1$ and $R^2$ are not all H, and when z=1, at least R or $R^1$ is not H; w,x,y=integers 0–13; z=integer of at least 1; and w+x+y+z=8–14; where the total number of carbon atoms in the branched primary, alkyl moiety of formula (I), including the R, $R^1$ and $R^2$ branching, is 14–20, and where further for the alcohol mixture the average total number of carbon atoms in the branched primary alkyl moieties having formula (I) is >14.5–17.5, preferably, >15–17; and (b) neutralising the alkyl sulphate acid produced by step (a), preferably using a base selected from KOH, NaOH, ammonia, monoethanolamine, triethanolamine and mixtures of these. Also disclosed is a method for manufacturing longer chain alkyl alkoxylated sulphate surfactant mixture compositions, comprising alkoxylating the specified long chain aliphatic alcohol mixture; sulphating the resulting polyoxyalkylene alcohol with $SO_3$; and neutralising the resulting alkyl alkoxylate sulphate acid. Alternatively, the alkyl alkoxylated sulphates may be produced directly from the polyoxyalkylene alcohol by sulphating with $SO_3$ and neutralising.

WO 98/23566 A Shell, published Jun. 4, 1998 discloses branched primary alcohol compositions having 8–36 C atoms and an average number of branches per mol of 0.7–3 and comprising ethyl and methyl branches. Also disclosed are: (1) a branched primary alkoxylate composition preparable by reacting a branched primary alcohol composition as above with an oxirane compound; (2) a branched primary alcohol sulphate preparable by sulphating a primary alcohol composition as above; (3) a branched alkoxylated primary alcohol sulphate preparable by alkoxylating and sulphating a branched alcohol composition as above; (4) a branched primary alcohol carboxylate preparable by oxidising a branched primary alcohol composition as above; (5) a detergent composition comprising: (a) surfactant(s) selected from branched primary alcohol alkoxylates as in (1), branched primary alcohol sulphates as in (2), and branched alkoxylated primary alcohol sulphates as in (3); (b) a builder; and (c) optionally additive(s) selected from foam control agents, enzymes, bleaching agents, bleach activators, optical brighteners, co-builders, hydrotropes and stabilisers. The primary alcohol composition, and the sulphates, alkoxylates, alkoxy sulphates and carboxylates prepared from them exhibit good cold water detergency and biodegradability.

Biodegradably branched surfactants useful herein also include the modified alkylaromatic, especially modified alkylbenzenesulfonate surfactants described in copending commonly assigned patent applications (P&G Case Nos. 7303P, 7304P). In more detail, these surfactants include (P&G Case 6766P) alkylarylsulfonate surfactant systems comprising from about 10% to about 100% by weight of said surfactant system of two or more crystallinity-disrupted alkylarylsulfonate surfactants of formula $(B\text{-}Ar\text{-}D)_a(M^{q+})_b$ wherein D is $SO_3$, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C. and wherein further said alkylarylsulfonate surfactant system has at least one of the following properties: percentage biodegradation, as measured by the modified SCAS test, that exceeds tetrapropylene benzene sulfonate; and weight ratio of nonquaternary to quaternary carbon atoms in B of at least about 5:1.

Such compositions also include (P&G Case 7303P) surfactant mixtures comprising (preferably, consisting essentially of): (a) from about 60% to about 95% by weight (preferably from about 65% to about 90%, more preferably from about 70% to about 85%) of a mixture of branched alkylbenzenesulfonates having formula (I):

(I)

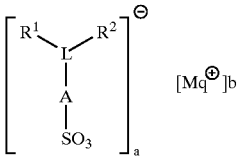

wherein L is an acyclic aliphatic moiety consisting of carbon and hydrogen and having two methyl termini, and wherein said mixture of branched alkylbenzenesulfonates contains two or more (preferably at least three, optionally more) of said compounds differing in molecular weight of the anion of said formula (I) and wherein said mixture of branched alkylbenzenesulfonates is characterized by an average carbon content of from about 10.0 to about 14.0 carbon atoms (preferably from about 11.0 to about 13.0, more preferably from about 11.5 to about 12.5), wherein said average carbon content is based on the sum of carbon atoms in $R^1$, L and $R^2$, (preferably said sum of carbon atoms in $R^1$, L and $R^2$ is from 9 to 15, more preferably, 10 to 14) and further, wherein L has no substituents other than A, $R^1$ and $R^2$; M is a cation or cation mixture (preferably selected from H, Na, K, Ca, Mg and mixtures thereof, more preferably selected from H, Na, K and mixtures thereof, more preferably still, selected from H, Na, and mixtures thereof) having a valence q (typically from 1 to 2, preferably 1); a and b are integers selected such that said compounds are electroneutral (a is typically from 1 to 2, preferably 1, b is 1); $R^1$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said branched alkylbenzenesulfonates $R^2$ is H); A is a benzene moiety (typically A is the moiety —$C_6H_4$—, with the $SO_3$ moiety of Formula (I) in para-position to the L moiety, though in some proportion, usually no more than about 5%, preferably from 0 to 5% by weight, the $SO_3$ moiety is ortho- to L); and (b) from about 5% to about 60% by weight (preferably from about 10% to about 35%, more preferably from about 15% to about 30%) of a mixture of nonbranched alkylbenzenesulfonates having formula (II):

(II)

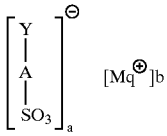

wherein a, b, M, A and q are as defined hereinbefore and Y is an unsubstituted linear aliphatic moiety consisting of carbon and hydrogen having two methyl termini, and wherein Y has an average carbon content of from about 10.0 to about 14.0 (preferably from about 11.0 to about 13.0, more preferably 11.5 to 12.5 carbon atoms); (preferably said mixture of nonbranched alkylbenzenesulfonates is further characterized by a sum of carbon atoms in Y, of from 9 to 15, more preferably 10 to 14); and wherein said composition is further characterized by a 2/3-phenyl index of from about 350 to about 10,000 (preferably from about 400 to about 1200, more preferably from about 500 to about 700) (and also preferably wherein said surfactant mixture has a 2-methyl-2-phenyl index of less than about 0.3, preferably less than about 0.2, more preferably less than about 0.1, more preferably still, from 0 to 0.05).

Also encompassed by way of mid-chain branched surfactants of the alkylbenzene-derived types are surfactant mixtures comprising the product of a process comprising the steps of: alkylating benzene with an alkylating mixture; sulfonating the product of (I); and neutralizing the product of (II); wherein said alkylating mixture comprises: (a) from about 1% to about 99.9%, by weight of branched $C_7$–$C_{20}$ monoolefins, said branched monoolefins having structures identical with those of the branched monoolefins formed by dehydrogenating branched parafins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_7$–$C_{20}$ linear aliphatic olefins; wherein said alkylating mixture contains said branched $C_7$–$C_{20}$ monoolefins having at least two different carbon numbers in said $C_7$–$C_{20}$ range, and has a mean carbon content of from about 9.5 to about 14.5 carbon atoms; and wherein said components (a) and (b) are at a weight ratio of at least about 15:85.

Bleaching System—The laundry compositions of the present invention may comprise a bleaching system. Bleaching systems typically comprise a "bleaching agent" (source of hydrogen peroxide) and an "initiator" or "catalyst". When present, bleaching agents will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solyay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

(a) Bleach Activators—Preferably, the peroxygen bleach component in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzene-sulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_1$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshom et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Serial Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present laundry compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl)oxybenzenesulfonate,(6-nonanamidocaproyl) oxybenzenesulfonate, (6-decanamnidocaproyl)oxybenzenesulfonate and mixtures thereof.

Other useful activators, disclosed in U.S. Pat. Nos. 5,698,504, 5,695,679, 5,686,014 each of which is cited herein above and U.S. Pat. No. 4,966,723Hodge et al., issued Oct. 30, 1990, include benzoxazin-type activators, such as a $C_6H_4$ ring to which is fused in the 1,2-positions a moiety—$C(O)OC(R^1)=N$—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. Nos. 5,698,504, 5,695,679 and 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

(b) Organic Peroxides especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts—The present invention compositions and methods may utilize metal-containing bleach catalysts that are effective for use in bleaching compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

Manganese Metal Complexes—If desired, the compositions herein can be catalyzed by means of a manganese compound. Such compounds and levels of use are well known in the art and include, for example, the manganese-based catalysts disclosed in U.S. Pat. Nos. 5,576,282; 5,246,621; 5,244,594; 5,194,416; and 5,114,606; and European Pat. App. Pub. Nos. 549,271 A1, 549,272 A1, 544,440 A2, and 544,490 A1; Preferred examples of these catalysts include $Mn^{IV}{}_2(u\text{-}O)_3$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4(ClO_4)_4$, $Mn^{III}\text{-}Mn^{IV}{}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes—Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem,* 18, 1497–1502 (1979); *Inorg. Chem.,* 21, 2881–2885 (1982); *Inorg. Chem.,* 18 2023–2025 (1979); *Inorg. Synthesis,* 173–176 (1960); and *Journal of Physical Chemistry,* 56, 22–25 (1952).

Transition Metal Complexes of Macropolycyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein herein includes "having a superstructure" and "cross-bridged". "Rigid" has been defined as the constrained converse of flexibility: see D. H. Busch., *Chemical Reviews.*, (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews*, (1995), 95(38), 2629–2648 or Hancock et al., *Inorganica Chimica Acta*, (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a —$CH_2CH_2$—moiety. It bridges $N^1$ and $N^8$ in the illustrative structure. By comparison, a "same-side" bridge, for example if one were to be introduced across $N^1$ and $N^{12}$ in 1.11, would. not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in FIG. 1 and FIG. 2 below, can be used.

FIG. 1

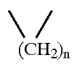

wherein n is an integer, for example from 2 to 8, preferably less than 6, typically 2 to 4, or

FIG. 2

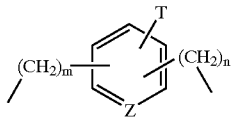

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

FIG. 3

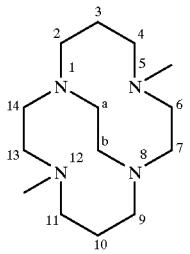

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo [6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or laundry uses, and non-limitingly illustrated by any of the following:

Dichloro-5,12-dimethyl-1,5,8,12-tetraazabicyclo[6.6.2] hexadecane Manganese(II)

Diaquo-5,12-dimethyl-1,5,8,12-tetraazabicyclo[6.6.2] hexadecaneManganese(II)Hexafluorophosphate Aquo-hydroxy-5,12-dimethyl-1,5,8,12-tetraazabicyclo [6.6.2]hexadecane Manganese(III)Hexafluorophosphate Diaquo-5,12-dimethyl-1,5,8,12-tetraazabicyclo[6.6.2] hexadecaneManganese(II)Tetrafluoroborate Dichloro-5,12-dimethyl-1,5,8,12-tetraazabicyclo[6.6.2] hexadecaneManganese(II)Hexafluorophosphate Dichloro-5,12-di-n-butyl-1,5,8,12-tetraaza bicyclo[6.6.2] hexadecaneManganese(II)

Dichloro-5,12-dibenzyl-1,5,8,12-tetraazabicyclo[6.6.2] hexadecaneManganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II)

Dichloro-5-n-butyl-12-methyl-1,5,8,12-tetraaza-bicyclo [6.6.2]hexadecane Manganese(II).

As a practical matter, and not by way of limitation, the compositions and laundry processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(d) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

(e) Bleach Boosting Compounds—The compositions herein may comprise one or more bleach boosting compounds. Bleach boosting compounds provide increased bleaching effectiveness in lower temperature applications. The bleach boosters act in conjunction with conventional peroxygen bleaching sources to provide increased bleaching effectiveness.

Suitable bleach boosting compounds for use in accordance with the present invention comprise cationic imines, zwitterionic imines, anionic imines and/or polyionic imines having a net charge of from about +3 to about −3, and mixtures thereof These imine bleach boosting compounds of the present invention include those of the general structure:

[I]

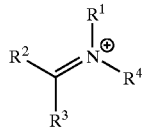

where $R^1$–$R^4$ may be a hydrogen or an unsubstituted or substituted radical selected from the group consisting of phenyl, aryl, heterocyclic ring, alkyl and cycloalkyl radicals.

Preferred bleach boosting compounds include where $R^1$–$R^4$ may be a hydrogen or an unsubstituted or substituted radical selected from the group consisting of phenyl, aryl, heterocyclic ring, alkyl and cycloalkyl radicals except that at least one of $R^1$–$R^4$ contains an anionically charged moiety.

More preferred bleach boosting compounds include the anionically charged moiety bonded to the imine nitrogen. Such bleach boosting compounds comprise quaternary imine zwitterions represented by the formula:

[II]

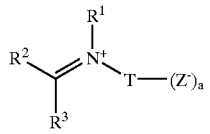

wherein $R^1$–$R^3$ is hydrogen or an unsubstituted or substituted radical selected from the group consisting of phenyl, aryl, heterocyclic ring, alkyl and cycloalkyl radicals; $R_1$ and $R_2$ form part of a common ring; T has the formula:

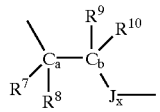

wherein x is equal to 0 or 1; J, when present, is selected from the group consisting of $—CR^{11}R^{12}—$, $—CR^{11}R^{12}CR^{13}R^{14}—$, and $—CR^{11}R^{12}CR^{13}R^{14}CR^{15}R^{16}—$; $R^7$–$R^{16}$ are individually selected from the group consisting of H, linear or branched $C_1$–$C_{18}$ substituted or unsubstituted alkyl, alkylene, oxyalkylene, aryl, substituted aryl, substituted arylcarbonyl groups and amide groups; Z is covalently bonded to $J_x$ when x is 1 and to $C_b$ when x is 0, and Z is selected from the group consisting of $—CO_2^-$, $—SO_3^-$ and $—OSO_3^-$ and a is 1. $R_1$ and $R_2$ together may form the non-charged moiety:

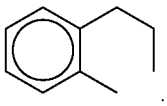

Most preferred bleach boosting compounds include are aryliminium zwitterions wherein $R_3$ is H, Z is $—SO_3^-$ or $—OSO_3^-$, and a is 1. The aryliminium zwitterions may have the formula:

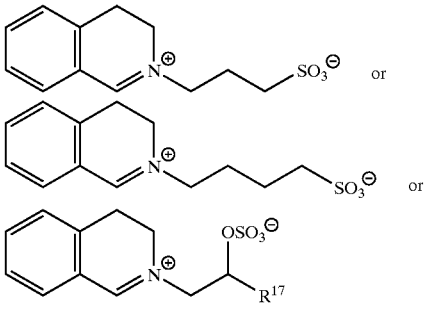

where $R^{17}$ is selected from the group consisting of H and linear or branched $C_1$–$C_{18}$ substituted or unsubstituted alkyl, preferably $C_1$–$C_{14}$ alkyl and even more preferably $C_8$–$C_{10}$ linear alkyl chain.

The bleach boosting compounds may also comprise an aryliminum polyion having a net negative charge and $R^3$ is H, T is $—(CH_2)_b—$ or $—CH_2(C_6H_4)—$, Z is $—SO_3^-$, a is 2 and b is from 2 to 4. The aryliminium polyion preferably has the formula:

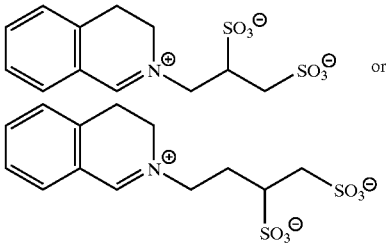

or is a water-soluble salt of these compounds.

The quaternary imine bleach boosting compounds preferably act in conjunction with a peroxygen source to provide a more effective bleaching system. The bleach boosting compounds react with the peroxygen source to form a more active bleaching species, an oxaziridinium compound. The formed oxaziridinium compounds are either cationic, zwitterionic or polyionic with a net negative charge as was the imine bleach boosting compound. The oxaziridinium compound has an increased activity at lower temperatures relative to the peroxygen compound. The oxaziridinium compound is represented by the formula:

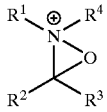

(III)

and can be produced from the imine of formula (I) or (II), wherein $R^4$ is $T—(Z^-)_a$, of the present invention with the reaction:

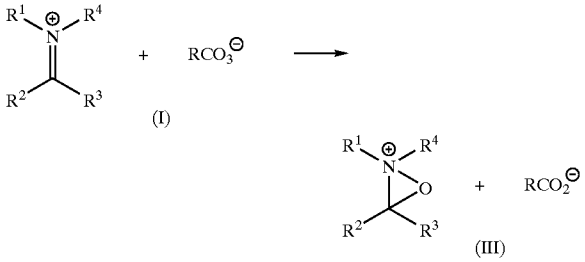

Thus, the preferred bleach boosting compounds of the present invention represented by the formula (II) produces the active oxaziridinium bleaching species represented by the formula:

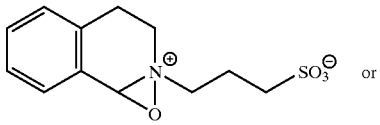

(IV)

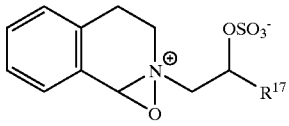

(V)

wherein $R^{17}$ is defined as above.

Peroxygen sources are well-known in the art and the peroxygen source employed in the present invention may comprise any of these well known sources, including peroxygen compounds as well as compounds which under consumer use conditions provide an effective amount of peroxygen in situ. The peroxygen source may include a hydrogen peroxide source, the in situ formation of a peracid anion through the reaction of a hydrogen peroxide source and a bleach activator, preformed peracid compounds or mixtures of suitable peroxygen sources. Of course, one of ordinary skill in the art will recognize that other sources of peroxygen may be employed without departing from the scope of the invention.

The bleach boosting compounds, when present, are preferably employed in conjunction with a peroxygen source in the bleaching compositions of the present invention. In such a composition, the peroxygen source is preferably present at a level of from about 0.1% to about 60% by weight of the composition, and more preferably from about 1% to about 40% by weight of the composition. In the composition, the bleach boosting compound is preferably present at a level of from about 0.01% to about 10% by weight of the composition, and more preferably from about 0.05% to about 5% by weight of the composition.

(f) Preformed Peracids—Also suitable as bleaching agents are preformed peracids, such as phthalimido-peroxycaproic acid ("PAP"). See for example U.S. Pat. Nos. 5,487,818, 5,310,934, 5,246,620, 5,279,757 and 5,132,431.

Enzymes—With respect to the enzymes in the particulate solid of the present invention, any suitable enzyme can be used. The preferred enzymes for use in the particulate solids of the present invention are selected from proteases, amylases, cellulases and mixtures thereof. Nonlimiting examples of other suitable enzymes include the following:

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, mannanases, more preferably plant cell wall degrading enzymes and non-cell wall-degrading enzymes (WO 98/39403 A) and can, more specifically, include pectinase (WO 98/06808 A, JP10088472 A, JP10088485 A); pectolyase (WO98/06805 A1); pectin lyases free from other pectic enzymes (WO9806807 A1); chondriotinase (EP 747,469 A); xylanase (EP 709,452 A, WO 98/39404 A, WO98/39402 A) including those derived from *microtetraspora flexuosa* (U.S. Pat. No. 5,683,911); isopeptidase (WO 98/16604 A); keratinase (EP 747,470 A, WO 98/40473 A); lipase (GB 2,297,979 A; WO 96/16153 A; WO 96/12004 A; EP 698,659 A; WO 96/16154 A); cellulase or endoglucanase (GB 2,294,269 A; WO 96/27649 A; GB 2,303,147 A; WO98/03640 A; see also neutral or alkaline cellulases derived from chrysosporium lucknowense strain VKM F-3500D as disclosed in WO9815633 A); polygalacturonase (WO 98/06809 A); mycodextranase (WO 98/13457 A); thermitase (WO 96/28558 A); cholesterol esterase (WO 98 28394 A); or any combination thereof; and known amylases; oxidoreductases; oxidases or combination systems including same (DE19523389 A1); mutant blue copper oxidases (WO9709431 A1), peroxidases (see for example U.S. Pat. No. 5,605,832, WO97/31090 A1), mannanases (WO9711164 A1); laccases, see WO9838287 A1 or WO9838286 A1 or for example, those laccase variants having amino acid changes in myceliophthora or scytalidium laccase(s) as described in WO9827197 A1 or mediated laccase systems as described in DE19612193 A1), or those derived from coprinus strains (see, for example WO9810060 A1 or WO9827198 A1), phenol oxidase or polyphenol oxidase (JP10174583 A) or mediated phenol oxidase systems (WO9711217 A); enhanced phenol oxidase systems (WO 9725468 A WO9725469 A); phenol oxidases fused to an amino acid sequence having a cellulose binding domain (WO9740127 A1, WO9740229 A1) or other phenol oxidases (WO9708325 A, WO9728257 A1) or superoxide dismutases. Oxidoreductases and/or their associated antibodies can be used, for example with $H_2O_2$, as taught in WO 98/07816 A. Depending on the type of detergent composition, other redox-active enzymes can be used, even, for example, catalases (see, for example JP09316490 A).

Also useful herein are any oxygenases of extracellular origin, especially fungal oxygenase such as dioxygenase of extracellular origin. The latter is most especially quercetinase, catechinase or an anthocyanase, optionally in combination with other suitable oxidase, peroxidase or hydrolytic enzymes, all a taught in WO9828400 A2.

Examples of such suitable enzymes and/or levels of use are disclosed in U.S. Pat. Nos. 5,705,464, 5,710,115, 5,576,282, 5,728,671 and 5,707,950.

The cellulases useful in the present invention include both bacterial or fungal cellulases. Preferably, they will have a pH optimum of between 5 and 12 and a specific activity above 50 CEVU/mg (Cellulose Viscosity Unit). Suitable cellulases are disclosed in U.S. Pat. No. 4,435,307, J61078384 and WO96/02653 which discloses fungal cellulase produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (Humicola grisea var. thermoidea), particularly the Humicola strain DSM 1800.

Other suitable cellulases are cellulases originated from Humicola insolens having a molecular weight of about 50 KDa, an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in WO 91/17243. Also suitable cellulases are the EGIII cellulases from Trichoderma longibrachiatum described in WO94/21801 to Genencor. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or laundry properties are described in WO96/34092, WO96/17994 and WO95/24471.

Peroxidase enzymes are used in combination with oxygen sources, e.g. percarbonate, perborate, persulfate, hydrogen peroxide, etc and with a phenolic substrate as bleach enhancing molecule. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Suitable peroxidases and peroxidase-containing detergent compositions are disclosed, for example, in U.S. Pat. Nos. 5,705,464, 5,710,115, 5,576,282, 5,728,671 and 5,707,950, PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Suitable enhancers are selected from the group consisting of substituted phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621), substitued syringates (C3–C5 substitued alkyl syringates), phenols and mixtures thereof. Sodium percarbonate or perborate are preferred sources of hydrogen peroxide.

Enzymatic systems may be used as bleaching agents. The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other preferred enzymes that can be included in the laundry compositions of the present invention include lipases. Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism *Pseudomnonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase$^R$ and Lipomax$^R$ (Gist-Brocades) and Lipolase$^R$ and Lipolase Ultra$^R$(Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to laundry compositions have been described in e.g. WO-A-88/09367 (Genencor); WO 90/09446 (Plant Genetic System) and WO 94/14963 and WO 94/14964 (Unilever).

In addition to the above referenced lipases, phospholipases may be incorporated into the laundry compositions of the present invention. Nonlimiting examples of suitable phospholipases included: EC 3.1.1.32 Phospholipase A1; EC 3.1.1.4 Phospholipase A2; EC 3.1.1.5 Lysopholipase; EC 3.1.4.3 Phospholipase C; EC 3.1.4.4. Phospolipase D. Commercially available phospholipases include LECITASE® from Novo Nordisk A/S of Denmark and Phospholipase A2 from Sigma. When phospolipases are included in the compositions of the present invention, it is preferred that amylases are also included. Without desiring to be bound by theory, it is believed that the combined action of the phospholipase and amylase provide substantive stain removal, especially on greasy/oily, starchy and highly colored stains and soils. Preferably, the phospholipase and amylase, when present, are incorporated into the compositions of the present invention at a pure enzyme weight ratio between 4500:1 and 1:5, more preferably between 50:1 and 1:1.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Suitable is the protease called herein "Protease C", which is a variant of an alkaline serine protease from Bacillus in which Lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase as described in U.S. Pat. No. 5,677,272, and WO95/10591. Also suitable is a carbonyl hydrolase variant of the protease described in WO95/10591, having an amino acid sequence derived by replacement of a plurality of amino acid residues replaced in the precursor enzyme corresponding to position +210 in combination with one or more of the following residues : +33, +62, +67, +76, +100, +101, +103, +104, +107, +128, +129, +130, +132, +135, +156, +158, +164, +166, +167, +170, +209, +215, +217, +218, and +222, where the numbered position corresponds to naturally-occurring subtilisin from *Bacillus amyloliquefaciens* or to equivalent amino acid residues in other carbonyl hydrolases or subtilisins, such as *Bacillus lentus* subtilisin (co-pending patent application U.S. Serial No. 60/048,550, filed Jun. 4, 1997 and PCT International Application Serial No. PCT/EB98/00853).

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Particularly useful proteases are described in PCT publications: WO 95/30010; WO 95/30011; and WO 95/29979. Suitable proteases are commercially available as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Preferred proteases useful herein include certain variants (WO 96/28566 A; WO 96/28557 A; WO 96/28556 A; WO 96/25489 A).

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillis amyloliquefaciens* subtilisin as described in PCT Application Nos. PCT/US98/22588, PCT/US98/22482 and PCT/US98/22486 all filed on Oct. 23, 1998 from The Procter & Gamble Company (P&G Cases 7280&, 7281& and 7282L, respectively). More preferably the protease variant includes a substitution set selected from the group consisting of:

12/76/103/104/130/222/245/261;

62/103/104/159/232/236/245/248/252;.

62/103/104/159/213/232/236/245/248/252;

62/101/103/104/159/212/213/232/236/245/248/252;

68/103/104/159/232/236/245;

68/103/104/159/230/232/236/245;

68/103/104/159/209/232/236/245;

68/103/104/159/232/236/245/257;

68/76/103/104/159/213/232/236/245/260;

68/103/104/159/213/232/236/245/248/252;

68/103/104/159/183/232/236/245/248/252;

68/103/104/159/185/232/236/245/248/252;

68/103/104/159/185/210/232/236/245/248/252;

68/103/104/159/210/232/236/245/248/252;

68/103/104/159/213/232/236/245;

98/103/104/159/232/236/245/248/252;

98/102/103/104/159/212/232/236/245/248/252;

101/103/104/159/232/236/245/248/252;

102/103/104/159/232/236/245/248/252;

103/104/159/230/236/245;

103/104/159/232/236/245/248/252;

103/104/159/217/232/236/245/248/252;

103/104/130/159/232/2361245/248/252;

103/104/131/159/232/236/245/248/252;

103/104/159/213/232/236/245/248/252; and

103/104/159/232/236/245.

Still even more preferably the protease variant includes a substitution set selected from the group consisting of:

12R/76D/103A/104T/130T/222S/245R/261D;

62D/103A/104I/159D/232V/236H/245R/248D/252K;

62D/103A/104I/159D/213R/232V/236H/245R/248D/252K;

68A/103A/104I/159D/209W/232V/236H/245R;

68A/76D/103A/104I/159D/213R/232V/236H/245R/260A;

68A/103A/104I/159D/213E/232V/236H/245R/248D/252K;

68A/103A/104I/159D/183D/232V/236H/245R/248D/252K;

68A/103A/104I/159D/232V/236H/245R;

68A/103A/104I/159D/230V/232V/236H/245R;

68A/103A/104I/159D/232V/236I/245R/257V;

68A/103A/104I/159D/213G/232V/236H/245R/248D/252K;

68A/103A/104I/159D/185D/232V/236H/245R/248D/252K;

68A/103A/104I/159D/185D/210L/232V/236H/245R/248D/252K;

68A/103A/104I/159D/210L/232V/236H/245R/248D/252K;

68A/103A/104I/159D/213G/232V/236H/245R;

98L/103A/104I/159D/232V/236H/245R/248D/252K;

98L/102A/103A/104I/159D/212G/232V/236H/245R/248D/252K;

101G/103A/104I/159D/232V/236H/245R/248D/252K;

102A/103A/104I/159D/232V/236H/245R/248D/252K;

103A/104I/159D/230V/236H/245R;

103A/104I/159D/232V/236H/245R/248D/252K;

103A/104I/159D/217E/232V/236H/245R/248D/252K;

103A/104I/130G/159D/232V/236H/245R/248D/252K;

103A/104I/131 V/159D/232V/236H/245R/248D/252K;

103A/104I/159D/213R/232V/236H/245R/248D/252K; and

103A/104I/159D/232V/236H/245R.

Most preferably the protease variant includes the substitution set 101/103/104/159/232/236/245/248/252, preferably 101G/103A/104I/159D/232V/236H/245R/248D/252K.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Bleach/amylase/protease combinations (EP 755,999 A; EP 756,001 A; EP 756,000 A) are also useful.

Also in relation to enzymes herein, enzymes and their directly linked inhibitors, e.g., protease and its inhibitor linked by a peptide chain as described in WO 98/13483 A, are useful in conjunction with the present hybrid builders. Enzymes and their non-linked inhibitors used in selected combinations herein include protease with protease inhibitors selected from proteins, peptides and peptide derivatives as described in WO 98/13461 A, WO 98/13460 A, WO 98/13458 A, WO 98/13387 A.

Amylases can be used with amylase antibodies as taught in WO 98/07818 A and WO 98/07822 A, lipases can be used in conjunction with lipase antibodies as taught in WO 98/07817 A and WO 98/06810 A, proteases can be used in conjunction with protease antibodies as taught in WO 98/07819 A and WO 98/06811 A, Cellulase can be combined with cellulase antibodies as taught in WO 98/07823 A and WO 98/07821 A. More generally, enzymes can be combined with similar or dissimilar enzyme directed antibodies, for example as taught in WO 98/07820 A or WO 98/06812 A.

The preferred enzymes herein can be of any suitable origin, such as vegetable, animal, bacterial, fungal and yeast origin.

Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Amylases (α and/or β) can be included for removal of carbohydrate-based stains. WO94/02597 describes laundry compositions which incorporate mutant amylases. See also WO95/10603. Other amylases known for use in laundry compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314 and WO96/05295, Genencor, and amylase variants having additional modification in the immediate parent available from Novo Nordisk A/S, disclosed in WO 95/10603. Also suitable are amylases described in EP 277 216.

Examples of commercial α-amylases products are Purafect Ox Am® from Genencor and Tennamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. Preferably, the mannanase is selected from the group consisting of: three mannans-degrading enzymes:EC 3.2.1.25:β-mannosidase, EC 3.2.1.78:Endo-1,4-β-mannosidase, referred therein after as "mannanase" and EC 3.2.1.100:1,4-β-mannobiosidase and mixtures thereof. (IUPAC Classification—Enzyme nomenclature, 1992 ISBN 0-12-227165-3 Academic Press).

More preferably, the treating compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., Appl. Environ. Microbiol., Vol.56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55 C. and a pI of 4.8. JP-03047076 discloses a beta-mannanase derived from Bacillus sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps. An hemicellulase capable of degrading mannan-containing hemicellulose is described in WO91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradhaerens* NICMB 40482; the mannanase from *Bacillis suibtilis* strain 168, gene yght; the mannanase from Bacillus sp. I633 and/or the mannanase from Bacillus sp. AAI12. Most preferred mannanase for the inclusion in the detergent compositions of the present invention is the mannanase enzyme originating from Bacillus sp. I633 as described in the co-pending Danish patent application No. PA 1998 01340.

The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradhaerens* NICMB 40482 is described in the co-pending U.S. patent application serial No. 09/111,256. More specifically, this mannanase is:

i) a polypeptide produced by *Bacillus agaradhaerens*, NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

(a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;

(b) species homologs of (a);

(c) polynucleotide molecules that encode a polypeptide having mannanase activity that is at least 70% identical to the amino acid sequence of SEQ ID NO: 2 from amino acid residue 32 to amino acid residue 343 as shown in U.S. patent application Ser. No. 09/111,256;

(d) molecules complementary to (a), (b) or (c); and (e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SEQ ID No. 5 shown in the U.S. patent application Ser. No. 09/095,163 or an analogue of said sequence; and/or ii) a polypeptide comprising an amino acid sequence as shown SEQ ID NO:6 shown in the U.S. patent application Ser. No. 09/095,163; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. patent application Ser. No. 09/095,163

(b) species homologs of (a);

(c) polynucleotide molecules that encode a polypeptide having mannanase activity that is at least 70% identical to the amino acid sequence of SEQ ID NO: 6 as shown in the U.S. patent application Ser. No. 09/095,163;

(d) molecules complementary to (a), (b) or (c); and (e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. I633;

ii) a polypeptide comprising an amino acid sequence as shown in positions 33–340 of SEQ ID NO:2 as shown in the Danish application No. PA 1998 01340; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;

(b) species homologs of (a);

(c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;

(d) molecules complementary to (a), (b) or (c); and (e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase is described in the Danish co-pending patent application No. PA 1998 01341. More specifically, this mannanase is:

i) a polypeptide produced by Bacillus sp. AAI 12;

ii) a polypeptide comprising an amino acid sequence as shown in positions 25–362 of SEQ ID NO:2 as shown in the Danish application No. PA 1998 01341; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;

(b) species homologs of (a);

(c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;

(d) molecules complementary to (a), (b) or (c); and (e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

The mannanase, when present, is incorporated into the treating compositions of the present invention preferably at a level of from 0.0001% to 2%, more preferably from 0.0005% to 0.1%, most preferred from 0.001% to 0.02% pure enzyme by weight of the composition.

The compositions of the present invention may also comprise a xyloglucanase enzyme. Suitable xyloglucanases for the purpose of the present invention are enzymes exhibiting endoglucanase activity specific for xyloglucan, preferably at a level of from about 0.001% to about 1%, more preferably from about 0.01% to about 0.5%, by weight of the composition. As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 μmol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

Suitable are enzymes exhibiting as its highest activity XGU endoglucanase activity (hereinafter "specific for xyloglucan"), which enzyme:

i) is encoded by a DNA sequence comprising or included in at least one of the following partial sequences (a) ATTCATTTGT GGACAGTGGA C (SEQ ID No: 1)

(b) GTTGATCGCA CATTGAACCA (SEQ ID NO: 2)

(c) ACCCCAGCCG ACCGATTGTC (SEQ D NO: 3)

(d) CTTCCTTACC TCACCATCAT (SEQ ID NO: 4)

(e) TTAACATCTT TTCACCATGA (SEQ ID NO: 5)

(f) AGCTTTCCCT TCTCTCCCTT (SEQ ID NO: 6)

(g) GCCACCCTGG CTTCCGCTGC CAGCCTCC (SEQ ID NO: 7)

(h) GACAGTAGCA ATCCAGCATT (SEQ ID NO: 8)

(i) AGCATCAGCC GCTTTGTACA (SEQ ID NO: 9)

(j) CCATGAAGTT CACCGTATTG (SEQ ID NO: 10)

(k) GCACTGCTTC TCTCCCAGGT (SEQ ID NO: I1)

(l) GTGGGCGGCC CCTCAGGCAA (SEQ ID NO: 12)

(m) ACGCTCCTCC AATTTTCTCT (SEQ ID NO: 13)

(n) GGCTGGTAG TAATGAGTCT (SEQ ID NO: 14)

(o) GGCGCAGAGT TTGGCCAGGC (SEQ ID NO: 15)

(p) CAACATCCCC GGTGTTCTGG G (SEQ ED NO: 16)

(q) AAAGATTCAT TTGTGGACAG TGGACGTTGA TCGCACATTG AACCAACCCC AGCCGACCGA TTGTCCTTCC TTACCTCACC ATCATTTAAC ATCTTTTCAC CATGAAGCTT TCCCTTCTCT CCCTTGCCAC CCTGGCTTCC GCTGCCAGCC TCCAGCGCCG CACACTTCTG CGGTCAGTGG GATACCGCCA CCGCCGGTGA CTTCACCCTG TACAACGACC TTTGGGGCGA GACGGCCGGC ACCGGCTCCC AGTGCACTGG AGTCGACTCC TACAGCGGCG ACACCATCGC TTGTCACACC AGCAGGTCCT GGTCGGAGTA GCAGCAGCGT CAAGAGCTAT GCCAACG (SEQ ID NO:17) or (r) CAGCATCTCC ATTGAGTAAT CACGTTGGTG TTCGGTGGCC CGCCGTGTTG CGTGGCGGAG GCTGCCGGGA GACGGGTGGG GATGGTGGTG GGAGAGAATG TAGGGCGCCG TGTTTCAGTC CCTAGGCAGG ATACCGGAAA ACCGTGTGGT AGGAGGTTTA TAGGTTTCCA GGAGACGCTG TATAGGGGAT AAATGAGATT GAATGGTGGC CACACTCAAA CCAACCAGGT CCTGTACATA CAATGCATAT ACCAATTATA CCTACCAAAA AAAAAAAAAA AAAAAAAAAA AAAA (SEQ ID NO:18)

or a sequence homologous thereto encoding a polypeptide specific for xyloglucan with endoglucanase activity, ii) is immunologically reactive with an antibody raised against a highly purified endoglucanase encoded by the DNA sequence defined in i) and derived from *Aspergillus aculeatus*, CBS 101.43, and is specific for xyloglucan.

More specifically, as used herein the term "specific for xyloglucan" means that the endoglucanse enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and prehybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labelled probe for 18 h at −40° C. and washing three times in 2×SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGUICMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species *A. aculeatus*, as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanses specific for xyloglucan whenever extensive degradation of xyloglucan is desirable. An additional advantage of a microbial enzyme is that it, in general, may be produced in higher amounts in a microbial host, than enzymes of other origins.

The xyloglucanase, when present, is incorporated into the treating compositions of the invention preferably at a level of from 0.0001% to 2%, more preferably from 0.0005% to 0.1%, most preferred from 0.001% to 0.02% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the laundry detergent and/or fabric care compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular laundry application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

Other suitable cleaning adjunct materials that can be added are enzyme oxidation scavengers. Examples of such enzyme oxidation scavengers are ethoxylated tetraethylene polyamines.

A range of enzyme materials are also disclosed in WO 9307263 and WO 9307260 to Genencor International, WO 8908694, and U.S. Pat. No. 3,553,139, Jan. 5, 1971 to McCarty et al. Enzymes are further disclosed in U.S. Pat. No. 4,101,457, and in U.S. Pat. No. 4,507,219. Enzyme materials particularly useful for liquid detergent formulations, and their incorporation into such formulations, are disclosed in U.S. Pat. No. 4,261,868. *Enzyme Stabilizers*—Enzymes for use in detergents can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful Bacillus, sp. AC13 giving proteases, xylanases and cellulases, is described in WO 9401532. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

Builders—The detergent and laundry compositions described herein preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder. Lower or higher levels of builder, however, are not meant to be excluded.

Preferred builders for use in the detergent and laundry compositions, particularly dishwashing compositions, described herein include, but are not limited to, water-soluble builder compounds, (for example polycarboxylates) as described in U.S. Pat. Nos. 5,695,679, 5,705,464 and 5,710,115. Other suitable polycarboxylates are disclosed in U.S. Pat. Nos. 4,144,226, 3,308,067 and 3,723,322. Preferred polycarboxylates are hydroxycarboxylates containing up to three carboxy groups per molecule, more particularly titrates.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates (see, for example, U.S. Pat. Nos. 3,159,581; 3,213,030; 3,422,021; 3,400,148 and 3,422,137), phytic acid, silicates, carbonates (including bicarbonates and sesquicarbonates), sulphates, and aluminosilicates.

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Suitable silicates include the water-soluble sodium silicates with an $SiO_2$:$Na_2O$ ratio of from about 1.0 to 2.8, with ratios of from about 1.6 to 2.4 being preferred, and about 2.0 ratio being most preferred. The silicates may be in the form of either the anhydrous salt or a hydrated salt. Sodium silicate with an $SiO_2$:$Na_2O$ ratio of 2.0 is the most preferred. Silicates, when present, are preferably present in the detergent and laundry compositions described herein at a level of from about 5% to about 50% by weight of the composition, more preferably from about 10% to about 40% by weight.

Partially soluble or insoluble builder compounds, which are suitable for use in the detergent and laundry compositions, particularly granular detergent compositions, include, but are not limited to, crystalline layered silicates, preferably crystalline layered sodium silicates (partially water-soluble) as described in U.S. Pat. No. 4,664,839, and sodium aluminosilicates (water-insoluble). When present in detergent and laundry compositions, these builders are typically present at a level of from about 1% to 80% by weight, preferably from about 10% to 70% by weight, most preferably from about 20% to 60% by weight of the composition.

Crystalline layered sodium silicates having the general formula $NaMSi_xO_{2x+1}.yH_2O$ wherein M is sodium or hydrogen, x is a number from about 1.9 to about 4, preferably from about 2 to about 4, most preferably 2, and y is a number from about 0 to about 20, preferably 0 can be used in the compositions described herein. Crystalline layered sodium silicates of this type are disclosed in EP-A-0164514 and methods for their preparation are disclosed in DE-A-3417649 and DE-A-3742043. The most preferred material is delta-$Na_2SiO_5$, available from Hoechst AG as NaSKS-6 (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. SKS-6 is a highly preferred layered silicate for use in the compositions described herein herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used in the compositions described herein. Various other layered silicates from Hoechst 30 include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The crystalline layered sodium silicate material is preferably present in granular detergent compositions as a particulate in intimate admixture with a solid, water-soluble ionizable material. The solid, water-soluble ionizable material is preferably selected from organic acids, organic and inorganic acid salts and mixtures thereof.

Aluminosilicate builders are of great importance in most currently marketed heavy duty granular detergent compositions, and can also be a significant builder ingredient in liquid detergent formulations. Aluminosilicate builders have the empirical formula:

$$[M_z(AlO_2)_y].xH_2O$$

wherein z and y are integers of at least 6, the molar ratio of z to y is in the range from 1.0 to about 0.5, and x is an integer from about 15 to about 264. Preferably, the aluminosilicate builder is an aluminosilicate zeolite having the unit cell formula:

$$Na_z[(AlO_2)_z(SiO_2)_y].xH_2O$$

wherein z and y are at least 6; the molar ratio of z to y is from 1.0 to 0.5 and x is at least 5, preferably 7.5 to 276, more preferably from 10 to 264. The aluminosilicate builders are preferably in hydrated form and are preferably crystalline, containing from about 10% to about 28%, more preferably from about 18% to about 22% water in bound form.

These aluminosilicate ion exchange materials can be crystalline or amorphous in structure and can be naturally-occurring aluminosilicates or synthetically derived. A method for producing aluminosilicate ion exchange materials is disclosed in U.S. Pat. No. 25 3,985,669. Preferred synthetic crystalline aluminosilicate ion exchange materials useful herein are available under the designations Zeolite A, Zeolite B, Zeolite P, Zeolite X, Zeolite MAP and Zeolite HS and mixtures thereof. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Zeolite X has the formula:

$$Na_{86}[(AlO_2)_{86}(SiO_2)_{106}].276H_2O$$

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions described herein are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Dispersants—One or more suitable polyalkyleneimine dispersants may be incorporated into the laundry compositions of the present invention. Examples of such suitable dispersants can be found in European Patent Application Nos. 111,965, 111,984, and 112,592; U.S. Pat. Nos. 4,597,898, 4,548,744, and 5,565,145. However, any suitable clay/soil dispersent or anti-redepostion agent can be used in the laundry compositions of the present invention.

In addition, polymeric dispersing agents which include polymeric polycarboxylates and polyethylene glycols, are suitable for use in the present invention. Unsaturated monomeric acids that can be polymerized to form suitable polymeric polycarboxylates include acrylic acid. maleic acid (or maleic anhydride), fumaric acid, itaconic acid, aconitic acid, mesaconic acid, citraconic acid and methylenemalonic acid.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylatelmaleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents—The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

Chelating Agents—The compositions of the present invention herein may also optionally contain a chelating agent which serves to chelate metal ions and metal impurities which would otherwise tend to deactivate the bleaching agent(s). Useful chelating agents can include amino carboxylates, phosphonates, amino phosphonates, polyfunctionally-substituted aromatic chelating agents and mixtures thereof. Further examples of suitable chelating agents and levels of use are described in U.S. Pat. Nos. 5,705,464, 5,710,115, 5,728,671 and 5,576,282.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15%, more preferably from about 0.1% to about 3.0% by weight of the detergent compositions herein.

Suds suppressor—Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from 0.001% to 2% by weight of the composition, preferably from 0.01% to 1% by weight.

Softening agents—Fabric softening agents can also be incorporated into laundry detergent compositions in accordance with the present invention. Inorganic softening agents are exemplified by the smectite clays disclosed in GB-A-1 400 898 and in U.S. Pat. No. 5,019,292. Organic softening agents include the water insoluble tertiary amines as disclosed in GB-A-1 514 276 and EP-B-011 340 and their combination with mono C12–C14 quaternary ammonium salts are disclosed in EP-B-026 527 and EP-B-026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Particularly suitable fabric softening agents are disclosed in U.S. Pat. Nos. 5,707,950 and 5,728,673.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Biodegradable quaternary ammonium compounds as described in EP-A-040 562 and EP-A-239 910 have been presented as alternatives to the traditionally used di-long alkyl chain ammonium chlorides and methyl sulfates.

Non-limiting examples of softener-compatible anions for the quaternary ammonium compounds and amine precursors include chloride or methyl sulfate.

Dye transfer inhibition—The detergent compositions of the present invention can also include compounds for inhibiting dye transfer from one fabric to another of solubilized and suspended dyes encountered during fabric laundering and conditioning operations involving colored fabrics.

i. Polymeric Dye Transfer Inhibiting Agents

The detergent compositions according to the present invention can also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof. Examples of such dye transfer inhibiting agents are disclosed in U.S. Pat. Nos. 5,707,950 and 5,707,951.

Additional suitable dye transfer inhibiting agents include, but are not limited to, cross-linked polymers. Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in the co-pending European patent application 94870213.9.

Addition of such polymers also enhances the performance of the enzymes according the invention.

pH and Buffering Variation—Many of the detergent and laundry compositions described herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

Other Materials—Detersive ingredients or adjuncts optionally included in the instant compositions can include one or more materials for assisting or enhancing laundry performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, color speckles, silvercare, anti-tarnish and/or anti-corrosion agents, dyes, fillers, germicides, alkalinity sources, hydrotropes, anti-oxidants, perfumes, solubilizing agents, carriers, processing aids, pigments, and pH control agents as described in U.S. Pat. Nos. 5,705,464, 5,710,115, 5,698,504, 5,695,679, 5,686,014 and 5,646,101.

Methods of Laundry—In addition to the methods for laundry fabrics described herein, the invention herein also encompasses a laundering pretreatment process for fabrics which have been soiled or stained comprising directly contacting said stains and/or soils with a highly concentrated form of the laundry composition set forth above prior to washing such fabrics using conventional aqueous washing solutions. Preferably, the laundry composition remains in contact with the soil/stain for a period of from about 30 seconds to 24 hours prior to washing the pretreated soiled/stained substrate in conventional manner. More preferably, pretreatment times will range from about 1 to 180 minutes.

Product with Instructions for Use

The present invention also encompasses the inclusion of instructions on the use of the particulate solid containing compositions of the present invention with the packages containing the compositions herein or with other forms of advertising associated with the sale or use of the compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the compositions.

Specifically the instructions will include a description of the use of the composition, for instance, the recommended amount of composition to use in a washing machine to clean the fabric; the recommended amount of composition to apply to the fabric; if soaking or rubbing is appropriate.

The compositions of the present invention are preferably included in a product. The product preferably comprises a composition comprising one or more low density filler particles of the present invention and one or more particulate solids of the present invention, and optionally one or more cleaning adjunct materials, and further comprises instructions for using the product to launder fabrics by contacting a fabric in need of cleaning with an effective amount of the composition such that the composition cleans the fabric.

The following example is meant to exemplify the laundry detergent compositions and/or products of the present invention, but is not necessarily meant to limit or otherwise define the scope of the invention.

EXAMPLE

| | parts | parts | parts |
|---|---|---|---|
| Neodol 23-5 | 21.5 | 21.5 | 21.5 |
| n-BPP | 18.5 | 18.5 | 18.5 |
| Methyl sulfate salt of methyl quaternized polyethoxylated hexamethylenediamine | 1.3 | 1.3 | 1.3 |
| low density filler[1] | — | 0.26 | 0.52 |
| Na-citrate dihydrate | 6.8 | 6.8 | 6.8 |
| NaLAS | 16.0 | 16.0 | 16.0 |
| Na carbonate | 10.0 | 10.0 | 10.0 |
| brightener | 0.2 | 0.2 | 0.2 |
| Na percarbonate | 12.0 | 12.0 | 12.0 |
| bleach activator | 6.0 | 6.0 | 6.0 |
| thickening agent (CLASS) | 2.0 | 1.0 | 0.5 |
| enzymes | 1.23 | 1.23 | 1.32 |
| TiO2 | 0.5 | 0.5 | 0.5 |
| suds suppressor | 0.06 | 0.06 | 0.06 |
| perfume | 0.8 | 0.8 | 0.8 |

Average particle diameter of the low density filler to the average particle diameter of the suspended solids is about 2:1.

[1]Particulate solid density-reducing component is any particulate solid density-reducing component described herein. Preferably, the particulate solid density-reducing component is EXPANCEL ® 091 DE available from Expancel of Sweden.

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above examples, the compositions of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the invention in detail with reference to preferred embodiments and the examples, it will be clear to those skilled in the art that various changes and modifications may be made without departing from the scope of the invention and the invention is not to be considered limited to what is described in the specification.

What is claimed is:

1. A laundry detergent composition comprising:

a) one or more microspheres which comprise a polymer selected from the group consisting of polyacrylonitrile, polymethacrylonitrile, and mixtures thereof, further wherein said microspheres comprise an expandable material selected from the group consisting of liquid hydrocarbons, gases, and mixtures thereof; and b) one or more laundry adjunct ingredients in the form of a particulate solid;

wherein the ratio of the low density particles of (a) to the particulate solid of (b) is less than 6:1.

2. A composition according to claim 1 wherein the ratio of the low density particles of (a) to the particulate solid of (b) is less than 5:1.

3. A composition according to claim 2 wherein the ratio of the low density particles of (a) to the particulate solid of (b) is less than 4:1.

4. A composition according to claim 3 wherein the ratio of the low density particles of (a) to the particulate solid of (b) is less than 3:1.

5. A composition according to claim 4 wherein the ratio of the low density particles of (a) to the particulate solid of (b) is less than 2:1.

6. A composition according to claim 1 further comprising additional microspheres which comprise a polymeric material selected from the group consisting of silicaceous materials, proteins, ceramic materials, and mixtures thereof.

7. A composition according to claim 1 wherein said microsphere is capable of expanding to provide a particle having a density less than 0.4 g/mL.

8. A composition according to claim 7 wherein said microsphere is capable of expanding to provide a particle having a density less than 0.2 g/mL.

9. A composition according to claim 8 wherein said microsphere is capable of expanding to provide a particle having a density less than 0.1 g/mL.

10. A composition according to claim 1 wherein said adjunct ingredients are selected from the group consisting of surfactants, builders, bleaches, bleach activators, bleach catalysts, enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, hydrolyzable surfactants, preservatives, anti-oxidants, anti-shrinkage agents, anti-wrinkle agents, germicides, fungicides, color speckles, carriers, processing aids, pH control agents, and mixtures thereof.

11. A liquid laundry detergent composition comprising:

a) one or more microspheres which comprise a polymer selected from the group consisting of polyacrylonitrile, polymethacrylonitrile, and mixtures thereof, further wherein said microspheres comprise an expandable material selected from the group consisting of liquid hydrocarbons, gases, and mixtures thereof; and (b) one or more laundry adjunct ingredients in the form of a particulate solid; said laundry detergent composition does not form separated layers and the ratio of the low density particles of (a) to the particulate solid of (b) is less than 6:1.

12. A composition according to claim 11 wherein the ratio of the low density particles of (a) to the particulate solid of (b) is less than 5:1.

13. A composition according to claim 12 wherein the ratio of the low density particles of (a) to the particulate solid of (b) is less than 4:1.

14. A composition according to claim 13 wherein the ratio of the low density particles of (a) to the particulate solid of (b) is less than 3:1.

15. A composition according to claim 14 wherein the ratio of the low density particles of (a) to the particulate solid of (b) is less than 2:1.

16. A method for stabilizing a liquid laundry detergent composition from separating into a bilayer, said method comprising the step of combining one or more microspheres which comprise a polymer selected from the group consisting of polyacrylonitrile, polymethacrylonitrile, and mixtures thereof, further wherein said microspheres comprise an expandable material selected from the group consisting of liquid hydrocarbons, gases, and mixtures thereof; with one or more one or more laundry adjunct ingredients in the form of a particulate solid; thereby forming a detergent composition having a ratio of the low density particles of (a) to the particulate solid of (b) is less than 6:1.

* * * * *